US008264447B2

(12) United States Patent
Kimura et al.

(10) Patent No.: US 8,264,447 B2
(45) Date of Patent: Sep. 11, 2012

(54) DISPLAY APPARATUS AND METHOD FOR CONTROLLING A BACKLIGHT WITH MULTIPLE LIGHT SOURCES OF A DISPLAY UNIT

(75) Inventors: Kazuto Kimura, Kanagawa (JP); Shozo Masuda, Tokyo (JP); Masatake Hayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1078 days.

(21) Appl. No.: 11/277,055

(22) Filed: Mar. 21, 2006

(65) Prior Publication Data

US 2006/0214904 A1 Sep. 28, 2006

(30) Foreign Application Priority Data

Mar. 24, 2005 (JP) ..... P2005-087102
Jun. 22, 2005 (JP) ..... P2005-182365
Nov. 16, 2005 (JP) ..... P2005-331981

(51) Int. Cl.
*G09G 3/36* (2006.01)

(52) U.S. Cl. ..... 345/102; 345/698; 345/76; 345/82

(58) Field of Classification Search ..... 345/102, 345/698, 76–77, 82–83, 69–71, 204; 349/69–71; 362/97.1–97.4
See application file for complete search history.

(56) References Cited

U.S. PATENT DOCUMENTS 4,929,061 A * 5/1990 Tominaga et al. ..... 349/70
5,854,661 A * 12/1998 Kochanski ..... 348/602
6,111,560 A * 8/2000 May ..... 345/102
6,177,915 B1 1/2001 Beeteson et al.
6,608,614 B1 * 8/2003 Johnson ..... 345/102
6,828,954 B2 * 12/2004 Yoshihara et al. ..... 345/102
6,870,525 B2 * 3/2005 Kawabata et al. ..... 345/102
7,086,771 B2 * 8/2006 Kawabata et al. ..... 362/600
7,113,164 B1 * 9/2006 Kurihara ..... 345/102

(Continued)

FOREIGN PATENT DOCUMENTS

EP 1777693 A2 4/2007

(Continued)

OTHER PUBLICATIONS

Display Systems: Design and Applications 73 (Lindsay MacDonald and Anthony Lowe, eds., 1997).*

(Continued)

*Primary Examiner* — Lun-Yi Lao
*Assistant Examiner* — Gene W Lee
(74) *Attorney, Agent, or Firm* — SNR Denton US LLP

(57) ABSTRACT

A display apparatus includes a display unit having a display screen divided into a plurality of regions and controlled using a transmittance ratio on a pixel-by-pixel basis, a backlight including a plurality of sets of light sources, each set being disposed so as to correspond to one of the regions, and a control unit for identifying display luminance in each region, computing the emission luminance of each light source on the basis of the identified display luminance while taking into account an effect on the region of the other light sources not corresponding to the region, and computing a correction value for each pixel on the basis of a shift amount between the set emission luminance and an optimal display luminance for one of the regions, and delivering a display driving signal generated on the basis of the correction value to each pixel so as to control the luminance of the pixel.

8 Claims, 17 Drawing Sheets

U.S. PATENT DOCUMENTS

| | | | | |
|---|---|---|---|---|
| 7,176,878 | B2 * | 2/2007 | Lew et al. | 345/102 |
| 7,348,949 | B2 * | 3/2008 | Lee et al. | 345/83 |
| 7,425,943 | B2 * | 9/2008 | Furukawa | 345/102 |
| 7,436,386 | B2 * | 10/2008 | Ishiguchi | 345/102 |
| 7,460,103 | B2 * | 12/2008 | Konno et al. | 345/102 |
| 7,505,025 | B2 * | 3/2009 | Edelbrock | 345/102 |
| 7,548,030 | B2 * | 6/2009 | Korcharz et al. | 315/307 |
| 7,602,369 | B2 * | 10/2009 | Feng et al. | 345/102 |
| 7,622,697 | B2 * | 11/2009 | Korcharz et al. | 250/205 |
| 7,800,577 | B2 * | 9/2010 | Kerofsky et al. | 345/102 |
| 2001/0052891 | A1 * | 12/2001 | Yoshihara et al. | 345/102 |
| 2002/0075277 | A1 | 6/2002 | Naito et al. | |
| 2003/0016205 | A1 * | 1/2003 | Kawabata et al. | 345/102 |
| 2003/0076056 | A1 * | 4/2003 | Schuurmans | 315/291 |
| 2003/0231161 | A1 * | 12/2003 | Yamaguchi | 345/102 |
| 2005/0057484 | A1 * | 3/2005 | Diefenbaugh et al. | 345/102 |
| 2005/0057485 | A1 * | 3/2005 | Diefenbaugh | 345/102 |
| 2005/0078081 | A1 * | 4/2005 | Oda et al. | 345/102 |
| 2005/0117190 | A1 * | 6/2005 | Iwauchi et al. | 359/237 |
| 2005/0122287 | A1 * | 6/2005 | Nishitani et al. | 345/63 |
| 2005/0134547 | A1 * | 6/2005 | Wyatt | 345/102 |
| 2005/0135097 | A1 | 6/2005 | Kawabata et al. | |
| 2005/0156867 | A1 * | 7/2005 | Edelbrock | 345/102 |
| 2005/0184952 | A1 * | 8/2005 | Konno et al. | 345/102 |
| 2005/0190136 | A1 * | 9/2005 | Edelbrock | 345/88 |
| 2005/0237293 | A1 * | 10/2005 | Kim et al. | 345/102 |
| 2005/0270265 | A1 * | 12/2005 | Plut | 345/102 |
| 2006/0001641 | A1 * | 1/2006 | Degwekar et al. | 345/102 |
| 2006/0017687 | A1 * | 1/2006 | Oizumi et al. | 345/102 |
| 2006/0038770 | A1 * | 2/2006 | Burkholder | 345/102 |
| 2006/0044254 | A1 * | 3/2006 | Kirk | 345/102 |
| 2006/0050049 | A1 * | 3/2006 | Lin et al. | 345/102 |
| 2006/0071899 | A1 * | 4/2006 | Chang et al. | 345/102 |
| 2006/0097980 | A1 * | 5/2006 | Hasegawa | 345/102 |
| 2006/0125771 | A1 * | 6/2006 | Inuzuka et al. | 345/102 |
| 2006/0125773 | A1 * | 6/2006 | Ichikawa et al. | 345/102 |
| 2006/0181503 | A1 * | 8/2006 | Feng | 345/102 |
| 2006/0202945 | A1 * | 9/2006 | Feng | 345/102 |
| 2006/0209006 | A1 * | 9/2006 | Eckhardt | 345/102 |
| 2006/0267923 | A1 * | 11/2006 | Kerofsky | 345/102 |
| 2006/0274026 | A1 * | 12/2006 | Kerofsky | 345/102 |
| 2006/0284822 | A1 * | 12/2006 | Kerofsky et al. | 345/102 |
| 2006/0284823 | A1 * | 12/2006 | Kerofsky et al. | 345/102 |
| 2007/0001994 | A1 * | 1/2007 | Roth | 345/102 |
| 2007/0063961 | A1 * | 3/2007 | Kuroki | 345/102 |
| 2007/0279368 | A1 * | 12/2007 | Shefter | 345/102 |
| 2008/0259020 | A1 * | 10/2008 | Fisekovic et al. | 345/102 |

FOREIGN PATENT DOCUMENTS

| | | |
|---|---|---|
| JP | 03-071111 | 3/1991 |
| JP | 05-066501 | 3/1993 |
| JP | 2002-099250 | 4/2002 |
| JP | 2004-21503 | 7/2004 |
| JP | 2004-350179 | 12/2004 |
| JP | 2005-087102 | 4/2005 |
| JP | 2005-182365 | 7/2005 |
| JP | 2005-258403 | 9/2005 |
| JP | 2005-309338 | 11/2005 |
| JP | 2005-331981 | 12/2005 |
| WO | 2007/054865 A1 | 5/2007 |

OTHER PUBLICATIONS

Nalliah Raman and Gerben Hekstra; Dynamic Contrast Enhancement of Liquid Crystal Displays with Backlight Modulation; Phillips Research, Eindhoven, The Netherlands; IEEE 2005.

Naehyuck Chang et al.; DLS: Dynamic Backlight Luminance Scaling of Liquid Crystal Display; IEEE Transactions on Very Large Scale Integration (VLSD) Systems, vol. 12, No. 8, Aug. 2004.

Wei-Chung Cheng and Massoud Pedram; Power Minimization in a Backlit TFT-LCD Display by Concurrent Brightness and Contrast Scaling; IEEE 2004.

European Search Report dated Jul. 27, 2006.

A European Search Report in counterpart EP Application No. 06 005 529.0-2205 dated Mar. 24, 2009.

Japanese Office Action issued on Jul. 21, 2011, corresponding to counterpart JP Application No. 2005-331981.

* cited by examiner

FIG. 11C INVENTION

ORIGINAL IMAGE

BACKLIGHT

ORIGINAL IMAGE

DISPLAY APPARATUS AND METHOD FOR CONTROLLING A BACKLIGHT WITH MULTIPLE LIGHT SOURCES OF A DISPLAY UNIT

CROSS REFERENCES TO RELATED APPLICATIONS

The present invention contains subject matter related to Japanese Patent Application JP 2005-087102, JP 2005-182365, and JP 2005-331981 filed in the Japanese Patent Office on Mar. 24, 2005, Jun. 22, 2005, and Nov. 16, 2005, the entire contents of which are incorporated herein by reference.

BACKGROUND OF THE INVENTION

1. Field of the Invention

The present invention relates to a display apparatus and a display method suitable for use in, for example, a liquid crystal display device.

2. Description of the Related Art

In display apparatuses, for example, liquid crystal display devices, since pixels of a liquid crystal panel do not emit light by themselves, a backlight is disposed on the back surface of the liquid crystal panel to illuminate the back surface of the liquid crystal panel. Thus, an image can be displayed.

In known liquid crystal display devices, the backlight illuminates the entire display screen of a liquid crystal panel at a uniform intensity. By controlling the aperture ratio of each pixel of the liquid crystal panel to adjust the shielding of light emitted from the backlight, each portion of the display screen receives necessary luminance of light. Accordingly, for example, even when the entire display screen is dark, the backlight emits light substantially at its maximum intensity. This unnecessarily illuminating backlight increases the power consumption of a liquid crystal display device, which is a problem.

To solve such a problem of a liquid crystal display device having a backlight, for example, a method has been proposed for controlling the luminance of the entire backlight on the basis of display luminance information of the entire display screen.

Additionally, a method has been proposed for dividing the display screen into a plurality of regions in accordance with light sources of a backlight and individually controlling the luminance of the light sources in accordance with the required luminance for each divided region (refer to, for example, Japanese Unexamined Patent Application Publication No. 2004-212503).

As used herein, the term "emission luminance" refers to the luminance of light when the light is being emitted from a light source. The term "display luminance" refers to the luminance of light emitted from the light source when the light is passing through a display unit (display screen). This same definition is used throughout this specification.

FIGS. 18A and 18B schematically illustrate such a control method. For example, as shown in FIG. 18A, an image (original image) includes a dark elliptical portion substantially at the center of the image, and the image becomes progressively brighter towards the periphery thereof. A backlight c of a liquid crystal display device that displays this image includes a plurality of vertically and horizontally divided light sources d, d, d, . . . , as shown in FIG. 18B. To display the image shown in FIG. 18A, the two light sources d and d corresponding to the portion having the lowest display luminance are controlled to decrease the emission luminance.

By displaying an image while partially controlling the emission luminance of the backlight c, the unnecessary backlight emission is prevented, and therefore, the power consumption can be reduced.

SUMMARY OF THE INVENTION

However, in the above-described individual control of light sources, the distribution of display luminance of the display screen is sometimes unequal to the distribution of emission luminance of the backlight. Thus, the original image could not be faithfully played back.

For example, in the partial control of the emission luminance of the backlight c shown in FIGS. 18A and 18B, suppose that, as shown in FIG. 19, a portion A with a low luminance located at the center of the image contains a portion e with a high display luminance. Since the average luminance of the portion A is low, the emission luminance of the divided light sources d, d, d, . . . corresponding to the portion A is set to be low. Consequently, the portion e having a high display luminance cannot be displayed with a necessary display luminance, thereby decreasing the image quality.

Accordingly, there is provided a display apparatus and a display method that solve the above-described problem to increase the quality of an image while reducing the power consumption.

According to an embodiment of the present invention, a display apparatus includes a display unit having a display screen divided into a plurality of regions and being controlled using a transmittance ratio on a pixel-by-pixel basis, a backlight for illuminating the back surface of the display unit, the backlight including a plurality of sets of light sources, each set of which is disposed so as to correspond to one of the regions, and a control unit for identifying the display luminance in each region of the display unit when an image is displayed on the display unit on the basis of an input image signal, computing the emission luminance of each light source disposed so as to correspond to one of the divided regions on the basis of the identified display luminance while taking into account an effect on the region of the other light sources not corresponding to the region, setting the emission luminance of each light source disposed so as to correspond to one of the divided regions to the computed emission luminance, computing a correction value for each pixel of the display unit on the basis of a shift amount between the set emission luminance and an optimal display luminance value for one of the divided regions of the display screen, and delivering a display driving signal generated on the basis of the computed 1 correction value to each pixel so as to control the luminance of the pixel.

According to another embodiment of the present invention, a display method is provided for use in a display apparatus including a display unit having a display screen divided into a plurality of regions and being controlled using a transmittance ratio on a pixel-by-pixel basis, and a backlight for illuminating the back surface of the display unit. The backlight includes a plurality of sets of light sources, each set being disposed so as to correspond to one of the regions. The method includes the steps of identifying the display luminance in each region of the display unit when an image is displayed on the display unit on the basis of an input image signal, computing the emission luminance of each light source disposed so as to correspond to one of the divided regions on the basis of the identified display luminance while taking into account an effect on the region of the other light sources not corresponding to the region, setting the emission luminance of each light source disposed so as to correspond to one of the divided regions to the computed emission luminance, computing a correction value for each pixel of the display unit on the basis of a shift amount between the set emission luminance and an optimal display luminance value for one of the divided regions of the display screen, and delivering a display driving signal generated on the basis of the computed correction value to each pixel so as to control the luminance of the pixel.

As described above, a display apparatus includes a display unit having a display screen divided into a plurality of regions and being controlled using a transmittance ratio on a pixel-by-pixel basis, a backlight for illuminating the back surface of the display unit, the backlight including a plurality of sets of light sources, each set of which is disposed so as to correspond to one of the regions, and a control unit for identifying the display luminance in each region of the display unit when an image is displayed on the display unit on the basis of an input image signal, computing the emission luminance of each light source disposed so as to correspond to one of the divided regions on the basis of the identified display luminance while taking into account an effect on the region of the other light sources not corresponding to the region, setting the emission luminance of each light source disposed so as to correspond to one of the divided regions to the computed emission luminance, computing a correction value for each pixel of the display unit on the basis of a shift amount between the set emission luminance and an optimal display luminance value for one of the divided regions of the display screen, and delivering a display driving signal generated on the basis of the computed correction value to each pixel so as to control the luminance of the pixel.

Accordingly, the emission luminance of a light source corresponding to one of the regions is computed while taking into account an effect on the region of the other light sources not corresponding to the region, and the aperture ratio of each pixel is controlled on the basis of the computed emission luminance. As a result, the emission luminance of the light sources is efficiently controlled and the power consumption is reduced while providing emission luminance required for every area of the display screen. Thus, the quality of an image can be increased.

As described above, a display method for use in a display apparatus is provided. The display apparatus includes a display unit having a display screen divided into a plurality of regions and being controlled using a transmittance ratio on a pixel-by-pixel basis, and a backlight for illuminating the back surface of the display unit. The backlight includes a plurality of sets of light sources, each set being disposed so as to correspond to one of the regions. The method includes the steps of identifying the display luminance in each region of the display unit when an image is displayed on the display unit on the basis of an input image signal, computing the emission luminance of each light source disposed so as to correspond to one of the divided regions on the basis of the identified display luminance while taking into account an effect on the region of the other light sources not corresponding to the region, setting the emission luminance of each light source disposed so as to correspond to one of the divided regions to the computed emission luminance, computing a correction value for each pixel of the display unit on the basis of a shift amount between the set emission luminance and an optimal display luminance value for one of the divided regions of the display screen, and delivering a display driving signal generated on the basis of the computed correction value to each pixel so as to control the luminance of the pixel.

Accordingly, the emission luminance of a light source corresponding to one of the regions is computed while taking into account an effect on the region of the other light sources not corresponding to the region, and the aperture ratio of each pixel is controlled on the basis of the computed emission luminance. As a result, the emission luminance of the light sources is efficiently controlled and the power consumption is reduced while providing emission luminance required for every area of the display screen. Thus, the quality of an image can be increased.

BRIEF DESCRIPTION OF THE DRAWINGS

FIG. 9 is a graph illustrating the all-white display luminance and the uniform display luminance and FIG. 10 is a graph illustrating the uniform display luminance and the non-uniformity correction coefficient;

FIGS. 11A-C are schematic diagrams illustrating the control of an image as compared with an example of a known control;

DESCRIPTION OF THE PREFERRED EMBODIMENTS

Exemplary embodiments of the present invention are now herein described with reference to FIGS. 1 to 17.

In the following exemplary embodiments, a display apparatus of the exemplary embodiments is applied to a liquid crystal display device and a display method of the exemplary embodiments is applied to a method for displaying an image on the liquid crystal display device.

However, it should be appreciated that the present invention is not limited in this respect. The present invention can be applied to all the display apparatuses and all the display methods for displaying an image on the display apparatus in which a backlight is disposed on the back surface of a display unit of the display apparatus and an image is displayed by controlling the aperture ratio "transmittance ratio") of a pixel of the display unit.

Figure 1:
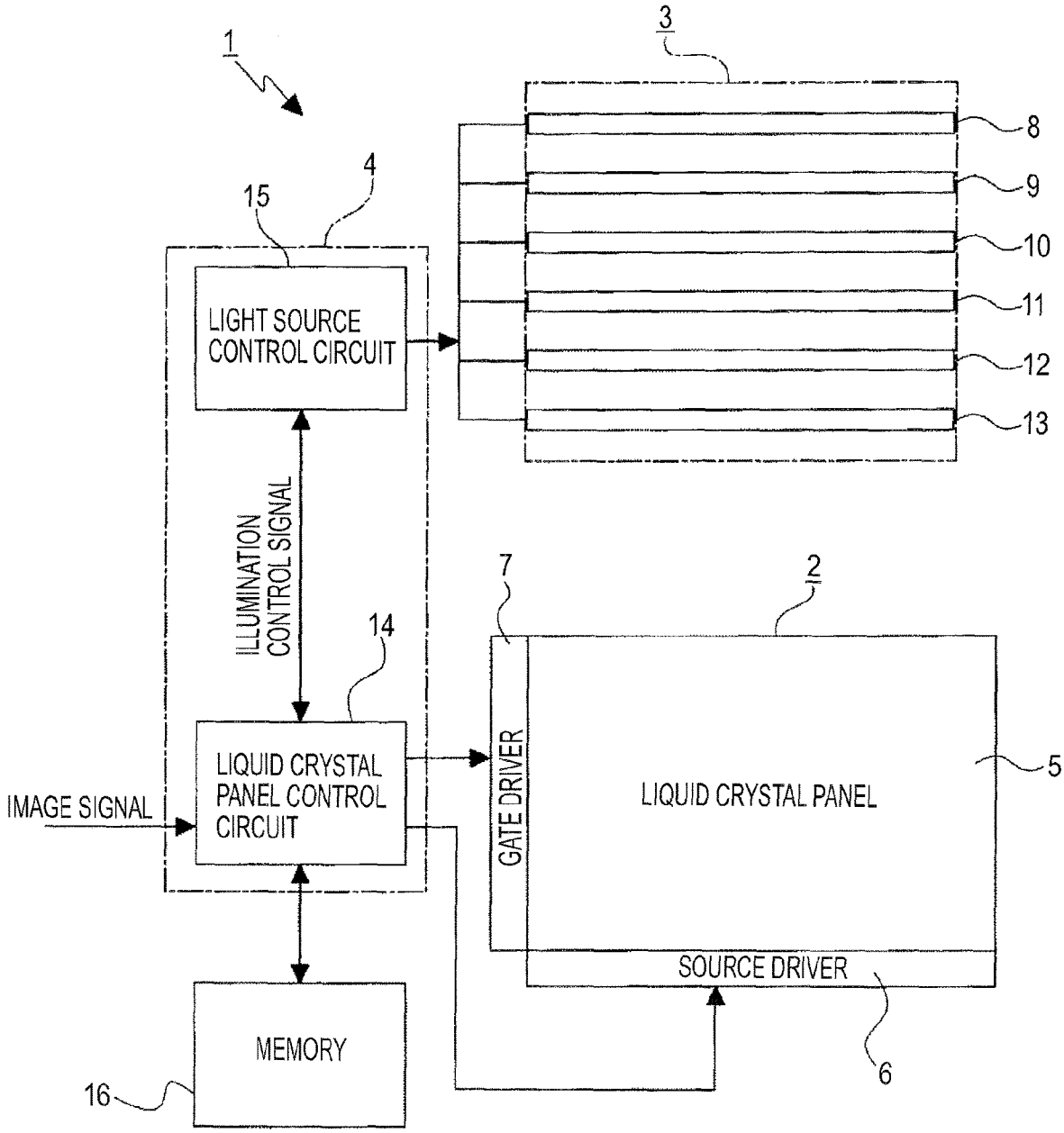
FIG. 1 is a block diagram of a liquid crystal display device for illustrating an embodiment of the best mode of the present invention together with FIGS. 2 to 17.

As shown in FIG. 1, a liquid crystal display device 1 includes a display unit 2 for displaying an image, a backlight 3 disposed on the back surface of the display unit 2, and a control unit 4 for controlling the backlight 3 and the display unit 2.

Figure 2:
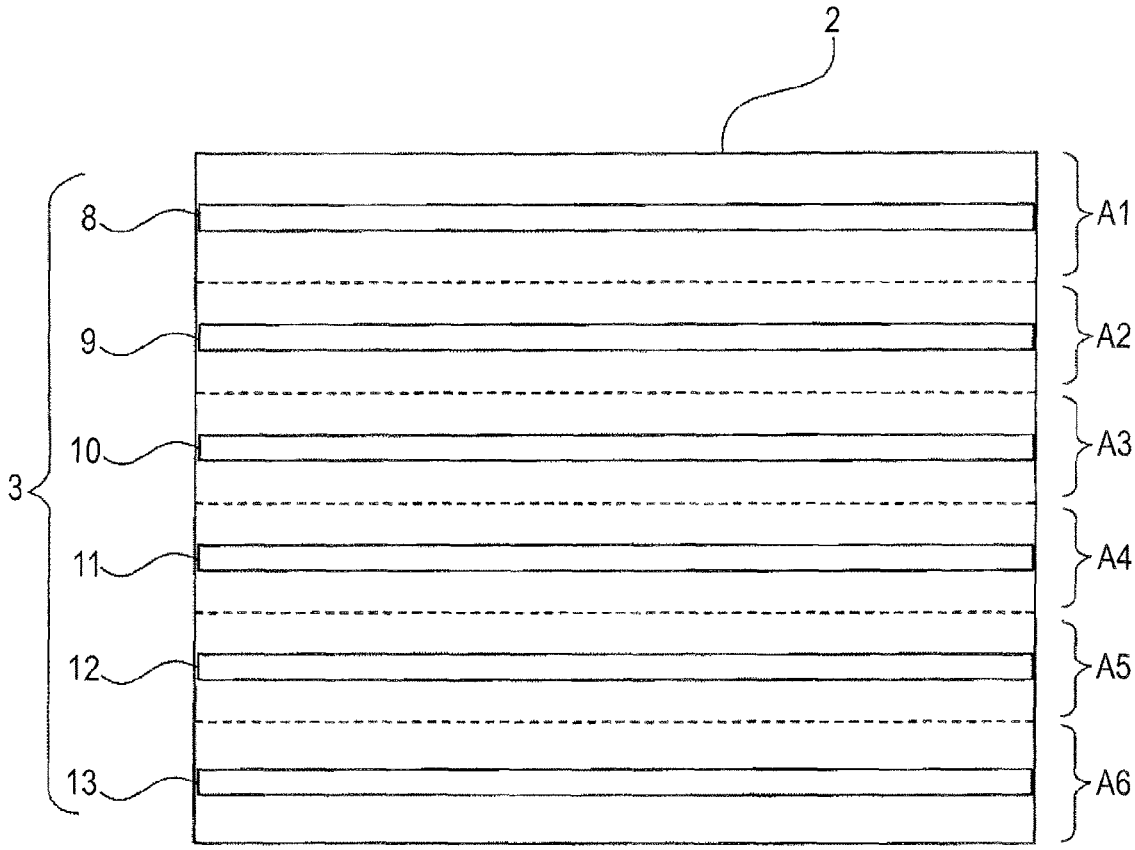
FIG. 2 schematically illustrates a display unit and a backlight.

The display unit 2 includes a liquid crystal panel 5, a source driver 6, and a gate driver 7. The source driver 6 and the gate driver 7 deliver driving signals to the liquid crystal panel 5. The display screen of the liquid crystal panel 5 is divided into a plurality of regions; for example, six vertically divided regions A1 to A6, as shown in FIG. 2.

The backlight 3 includes a plurality of light sources, for example, six light sources 8 to 13. The light sources 8 to 13 are disposed immediately behind the six regions A1 to A6 of the display screen, respectively. Each of the light sources 8 to 13 includes a plurality of horizontally arranged light emitting elements (e.g., light emitting diodes).

For example, a red light emitting diode, a green light emitting diode, and a blue light emitting diode are employed as the light emitting diodes of each of the light sources 8 to 13. By arranging these light emitting diodes in a predetermined order, the light of these colors are mixed so as to generate a pure white light. The light emitted from each of the light sources 8 to 13 is diffused by a scatter plate or a scatter sheet (not shown) and is emitted onto the back side of the liquid crystal panel 5.

It is noted that each of the regions A1 to A6 is determined to receive not only light emitted from one of the light sources 8 to 13 disposed immediately therebehind but also light emitted from other regions. Accordingly, the light emitted from each of the light sources 8 to 13 reaches regions other than the region immediately in front of the light source by means of the scatter plate or the like, which is described below.

Figure 18A:
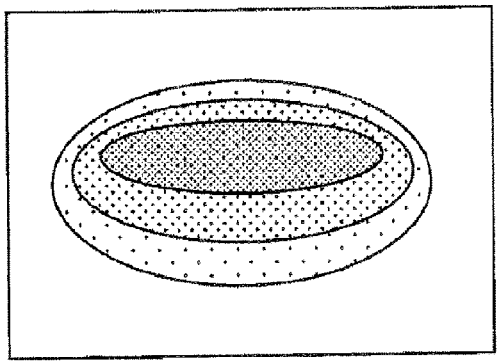
FIGS. 18A and 18B illustrate an example of an image and an example of the illumination state of a known backlight.
Figure 18B:
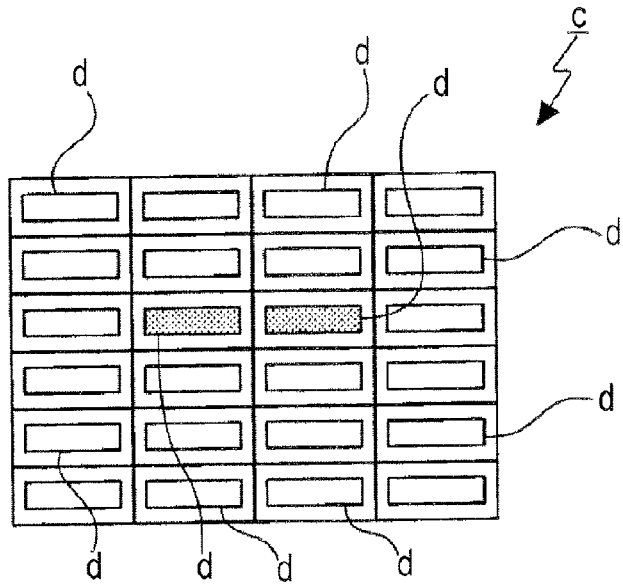
Figure 19:
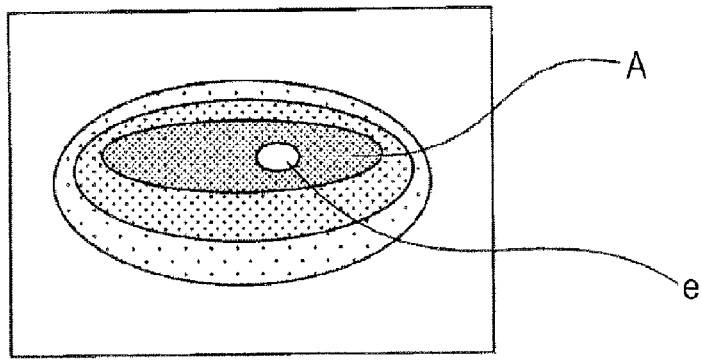
FIG. 19 is an example of an image for illustrating a known drawback.

For the sake of simplicity, in the foregoing description, the backlight 3 includes only the vertically divided light sources 8 to 13. However, the backlight 3 may include only the horizontally divided light sources. Alternatively, the backlight 3 may include vertically and horizontally divided light sources, as illustrated in a known example of FIG. 18B.

As shown in FIG. 1, the control unit 4 includes a light source control circuit 15 for controlling the backlight 3 and a liquid crystal panel control circuit 14 for controlling the display unit 2. A memory 16 is connected to the liquid crystal panel control circuit 14.

The memory 16 stores data associated with a distribution of light emitted from the light sources 8 to 13 and incident on the liquid crystal panel 5. The memory 16 further stores data used to correct the luminance non-uniformity of the liquid crystal panel 5.

In the liquid crystal display device 1 having such a structure, upon receiving an image signal, the liquid crystal panel control circuit 14 generates a display driving signal for controlling the display of the liquid crystal panel 5 on the basis of the input image signal.

The generated display driving signal is delivered to the source driver 6 and the gate driver 7 of the liquid crystal panel 5. The source driver 6 and the gate driver 7 input the display driving signal to each pixel of the liquid crystal panel 5 in one field cycle in synchronization with a field cycle of the input image signal. When the display driving signal is input to each pixel of the liquid crystal panel 5, the following correction process is carried out.

The light source control circuit 15 controls each of the light sources 8 to 13 (see FIG. 1). When the liquid crystal panel control circuit 14 receives an image signal, the liquid crystal panel control circuit 14 inputs an illumination control signal for each of the light sources 8 to 13 into the light source control circuit 15 so that the emission luminance of the light sources 8 to 13 are independently set at one field cycle.

Figure 3:
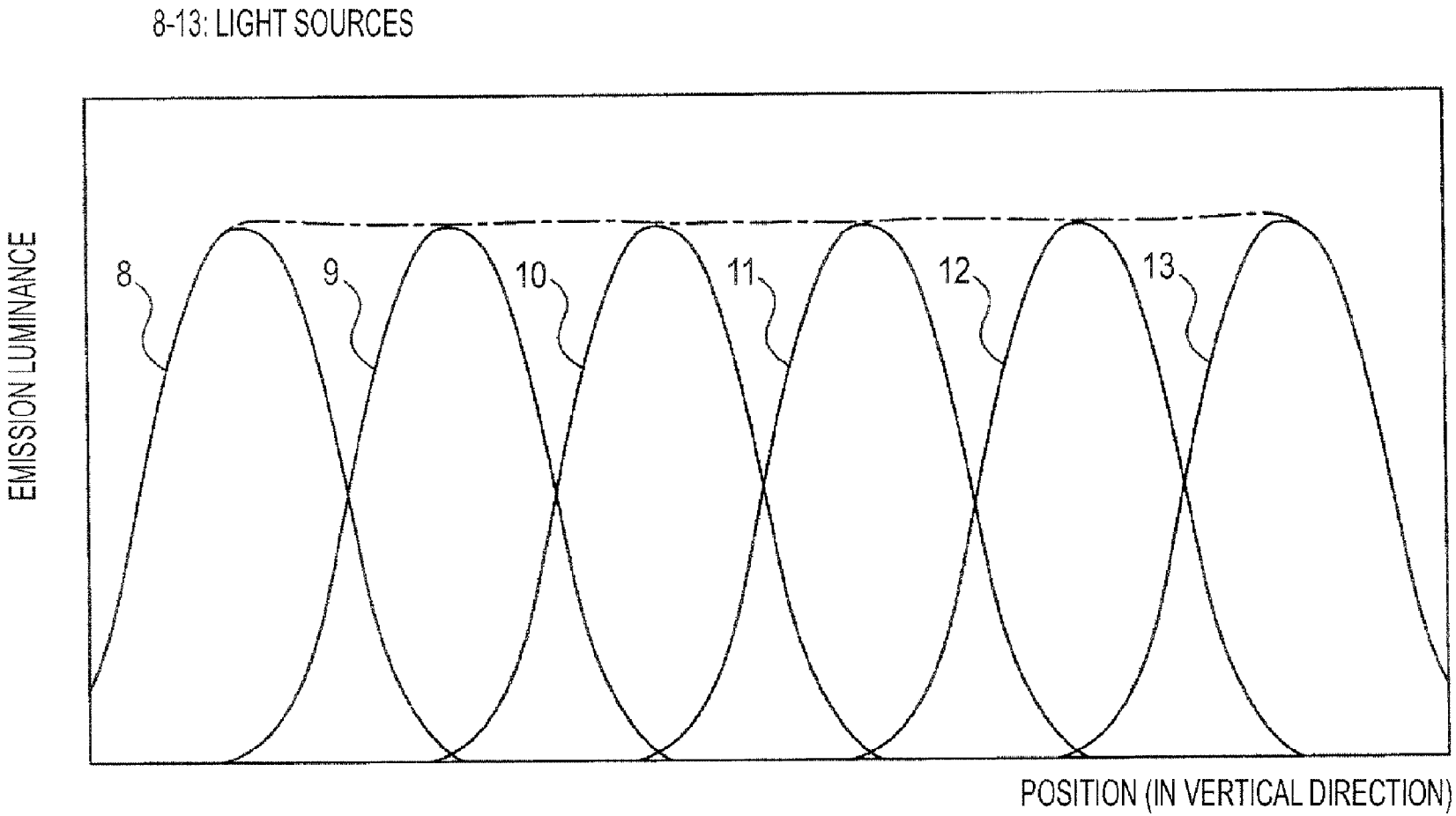
FIG. 3 is a graph illustrating the emission luminance of light sources at different positions in a display screen.

FIG. 3 illustrates an example of emission luminance of the light sources 8 to 13. In FIG. 3, the abscissa represents the vertical position in the display screen and the ordinate represents the emission luminance. Each of the light sources 8 to 13 is illuminated substantially at its maximum uniform luminance level.

In FIG. 3, the data represented by solid lines indicate the emission luminance of the light sources 8 to 13. Here, the effect of light reflected off either end of the display screen in the vertical direction (i.e., the ends of the light sources 8 and 13) is not taken into account in these data. The data represented by a dashed line indicates the total emission luminance of the light sources 8 to 13 at a location in the vertical direction. The total emission luminance at any point in the vertical direction is set to substantially the same with the exception of the total emission luminance at either end of the display screen in the vertical direction.

As described above, when the light sources 8 to 13 are illuminated substantially at the uniform intensity level, the total emission luminance decreases at either end of the display screen in the vertical direction. However, at either end of the display screen in the vertical direction, the emission luminance of the light sources 8 and 13 increases due to the effect of reflecting light (see FIG. 4). Accordingly, in the liquid crystal display device 1, the decrease in the total emission luminance is mitigated at either end of the display screen in the vertical direction.

Additionally, in the liquid crystal display device 1, in order to avoid the decrease in the total emission luminance at either end of the display screen in the vertical direction as much as possible, the maximum emission luminance of the light sources 8 and 13, which are located at either end of the display screen in the vertical direction, may be increased compared with that of the other light sources 9 to 12.

Figure 4:
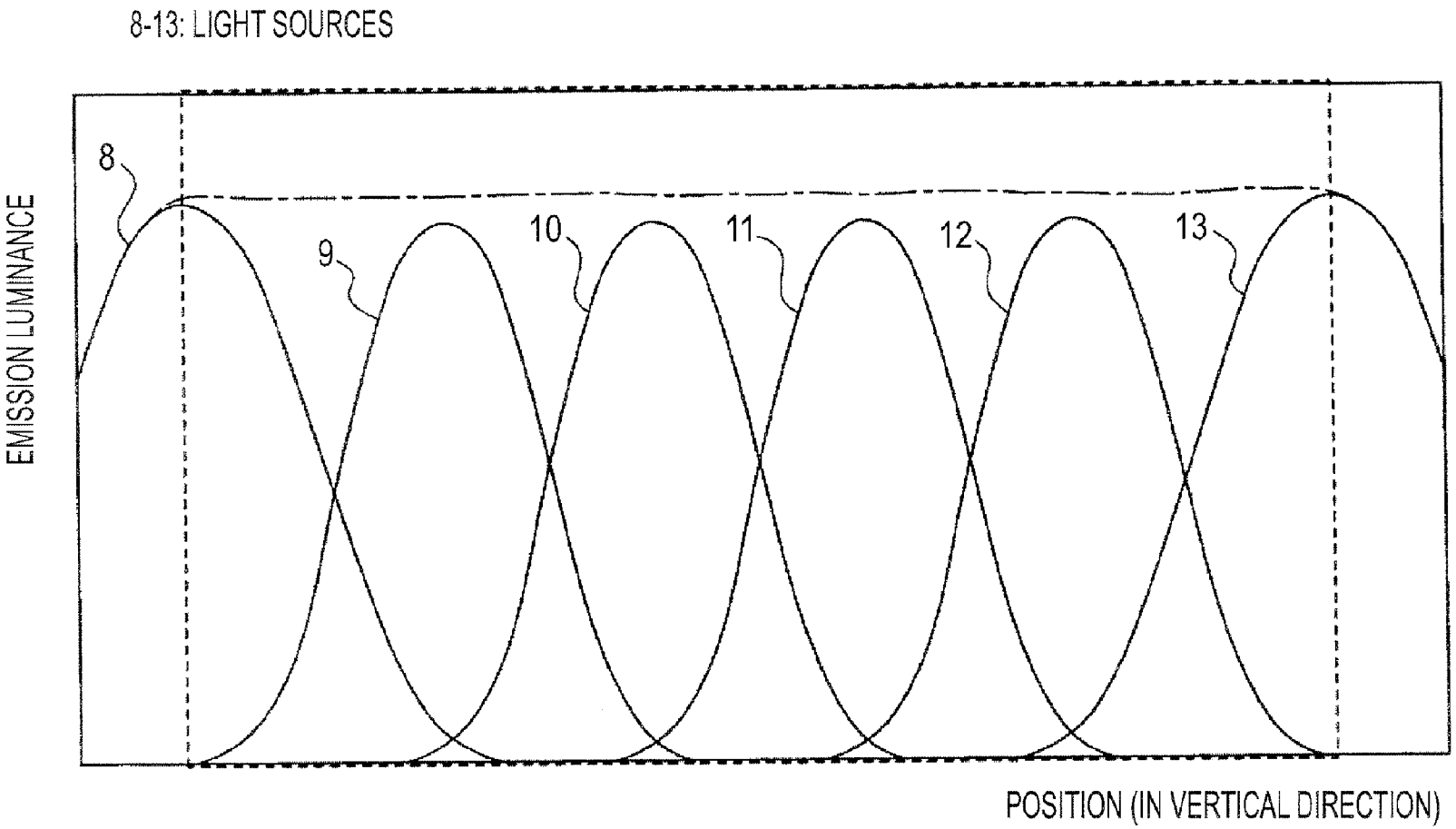
FIG. 4 is a graph illustrating the emission luminance of light sources at different positions in a display screen when taking into account the effect of reflection.

Furthermore, in order to completely avoid the decrease in the total emission luminance at either end of the display screen in the vertical direction, the area enclosed by a dotted line in FIG. 4 may be defined as an image displayable area, for example.

The liquid crystal display device 1 does not include a partition that prevents light emitted from each of the light sources 8 to 13 from reaching regions other than the region immediately in front of the light source. Accordingly, the light emitted from each of the light sources 8 to 13 reaches the regions other than the region immediately in front of the light source so as to contribute to the increase in the display luminance of those regions.

Figure 5:
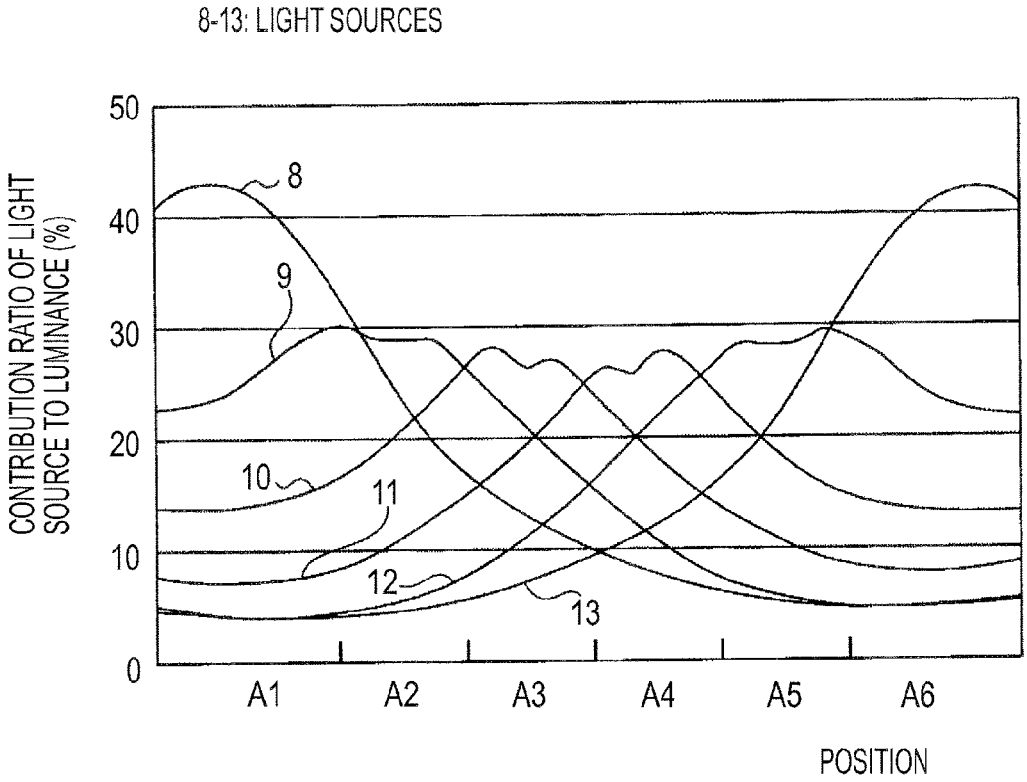
FIG. 5 is a graph illustrating the contribution ratios of the light sources to the luminance at different positions in the display screen.

FIG. 5 illustrates the contribution ratios of the light sources 8 to 13 to the luminance at different positions in the display screen when the light sources 8 to 13 having the emission luminance shown in FIG. 4 are used and the light emitted from the light sources 8 to 13 is incident on the liquid crystal panel 5. In FIG. 5, the abscissa represents the vertical position on the display screen and the ordinate represents the contribution ratios of the light emitted from the light sources 8 to 13 to the display luminance.

As can be seen from FIG. 5, the contribution ratios of light emitted from the light sources 8 to 13 are the highest to the luminance in the regions A1 to A6 located immediately in front of the light sources 8 to 13, respectively. The contribution ratio gradually decreases with distance from each of the regions A1 to A6. The contribution ratio of the light sources 8 and 13 disposed at either end in the vertical direction to the luminance in the regions A1 and A6 located immediately in front of the light sources 8 and 13 is about 40%, while the contribution ratio of the light sources 9 and 12 located between the light sources 8 and 13 to the luminance in the regions A2 and A5 located immediately in front of the light sources 9 and 12 is about 30%. Additionally, each of the light sources 8 to 13 also contributes to the luminance in a region other than the region immediately in front of the light source.

As described above, in the liquid crystal display device 1, the light emitted from each of the light sources 8 to 13 also reaches regions other than the region immediately in front of the light source. Therefore, light is emitted from each of the light sources 8 to 13 onto not only one of the regions A1 to A6 immediately in front of the light source but also the other regions.

In the liquid crystal display device 1, the contribution levels of the emission luminance of each of the light sources 8 to 13 to the regions A1 to A6 are measured in advance and are stored in the memory 16. These measurement values are used for solving simultaneous equations, which are described below. That is, the memory 16 stores data of the contribution ratio to the luminance shown in FIG. 5.

Figure 6:
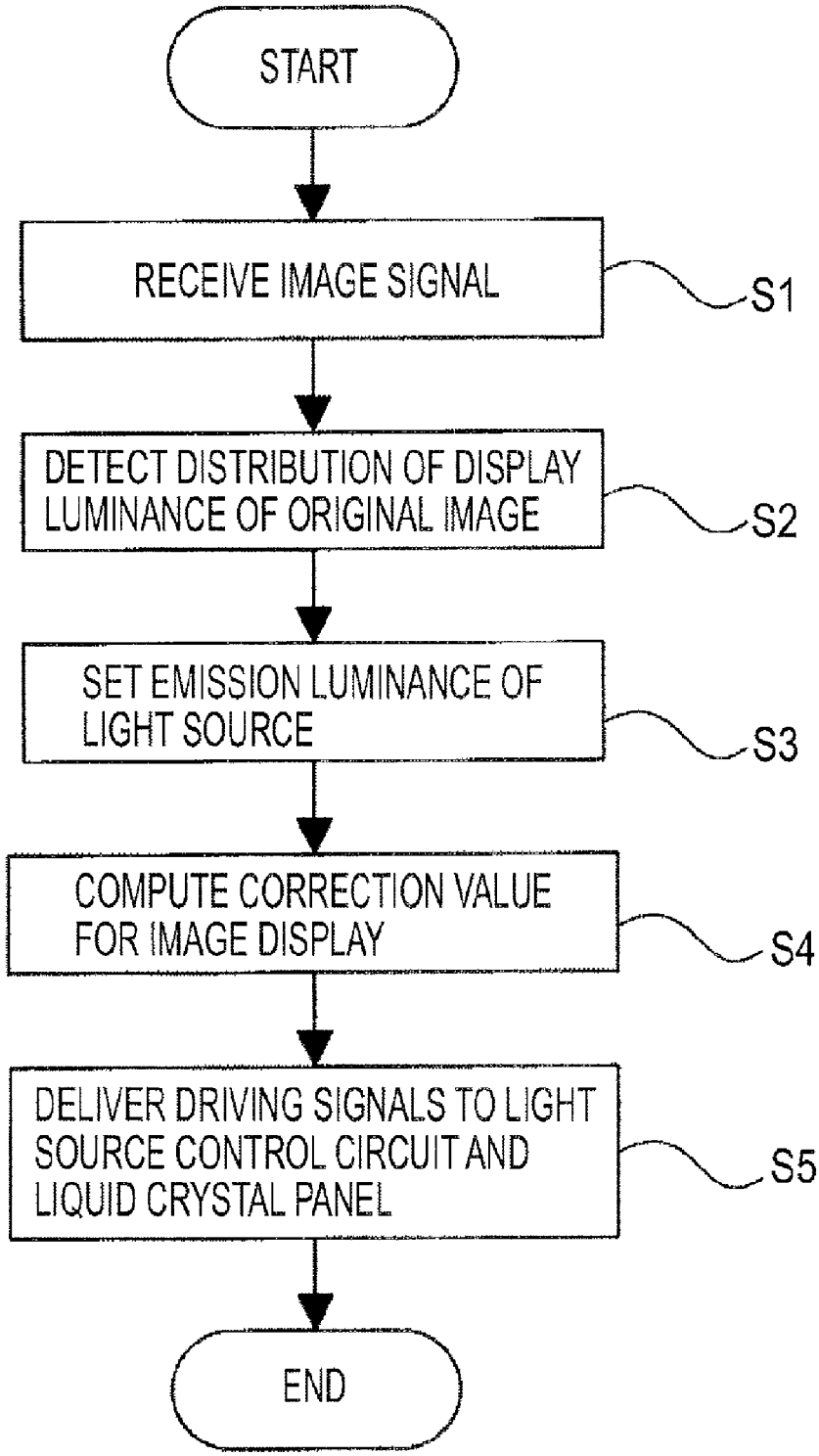
FIG. 6 is a flow chart of a control procedure.

The control process of the screen display is now herein described with reference to a flow chart shown in FIG. 6. This process is executed by the liquid crystal panel control circuit 14 and the light source control circuit 15 of the control unit 4 every time a one-field image signal is input to the liquid crystal panel control circuit 14.

Upon receiving a one-field image signal (step S1), the liquid crystal panel control circuit 14 identifies the distribution of display luminance of one image (original image) generated from the input image signal On the basis of the identified distribution of display luminance, the emission luminance is set for each of the light sources 8 to 13 of the backlight 3 (step S3). The display luminance is set with consideration of the contribution ratios of the emission luminance of each of the light sources 8 to 13 to the display luminance of the regions A1 to A6. More specifically, by using simultaneous equations and the above-described data about the contribution ratios prestored in the memory 16 (see FIG. 5), the emission luminance of each of the light sources 8 to 13 is set. An example of the simultaneous equations is described later.

After the emission luminance of each of the light sources 8 to 13 is set as described above, a correction value for each pixel is computed to obtain an optimal display luminance value when the image is displayed on the display screen of the liquid crystal panel 5 (step S4).

The correction value is computed on the basis of a difference between the set emission luminance of each of the light sources 8 to 13 and the optimal value. The optimal value refers to display luminance required for each region of the display screen when an original image is displayed on the basis of an input image signal. Accordingly, the correction value is a value for computing the aperture ratio of each pixel to obtain the display luminance required for each location on the display screen when light is emitted from the light sources 8 to 13 at the emission luminance level set as described above.

To compute the correction value, the data for correcting the luminance non-uniformity of the liquid crystal panel 5 is read out of the memory 16. Thereafter, the correction value is computed using these data.

Subsequently, the light source control circuit 15 delivers light emission driving signals in accordance with the emission luminance of the light sources 8 to 13 set at step S3 to the light sources 8 to 13, respectively. Thus, the light sources 8 to 13 emit light at the set emission luminance levels. At the same time, the liquid crystal panel control circuit 14 delivers, to pixels of the liquid crystal panel 5, display driving signals corrected on the basis of the correction values computed at step S4. Thus, an image of each field is displayed on the display screen (step S5). When the display driving signals are delivered from the liquid crystal panel control circuit 14 to the pixels of the liquid crystal panel 5, the pixels are controlled so that the aperture ratios of the pixels equal to the aperture ratios defined by the display driving signals. Thus, the transmission of light emitted from the light sources 8 to 13 through the pixels is controlled.

As a result, the image is displayed while maintaining the display luminance in accordance with the input image signal in each region of the display screen.

The controls carried out at steps S1 to S5 (see FIG. 6) are now herein described in detail.

Let N be the number of light sources of the backlight 3 (N is an integer greater than or equal to 2). In this embodiment, N=6.

In the liquid crystal display device 1, as shown in FIG. 2, the display screen is divided into six regions A1 to A6, which correspond to the N divided light sources.

For each of the regions A1 to A6, the maximum display luminance Ln_max (n=1, . . . 6) determined by the input image signal is computed. The maximum display luminance Ln_max refers to the value of a maximum display luminance in each of the regions A1 to A6.

Here, let L_peak be the all-white display luminance (i.e., a white peak setting is applied to both the liquid crystal panel and the backlight; in general, the aperture ratio of a liquid crystal panel is set to 100% and the output of the backlight is set to 100%). Let $\alpha n$ be the ratio of the maximum display luminance Ln_max to the all-white display luminance L_peak. Then, the ratio an (n=1, . . . 6) is computed for each of the regions A1 to A6 of the display screen.

That is, $$\alpha n = (\mathrm{Ln_max}/L_\mathrm{peak}) \quad (1)$$

The ratio $\alpha n$ represents how many percent of the emission luminance of the light sources 8 to 13 corresponding to the regions A1 to A6 can be reduced by (the recovery limit). That is, the display luminance of the liquid crystal panel 5 is determined by the aperture ratio of a liquid crystal panel (including a polarizer) multiplied by the emission luminance of the backlight. The term "recovery limit" refers to a minimum value that can provide the maximum display luminance Ln_max when the aperture ratio of the liquid crystal panel is set to 100%.

In the foregoing description, the recovery limit an is computed on the basis of the maximum display luminance Ln_max for each of the regions A1 to A6. However, depending on the displayed image, an average display luminance Ln_ave of each of the regions A1 to A6 may be obtained to compute a recovery limit $\alpha n'$ using the following equation: $\alpha n' = (\mathrm{Ln_ave}/\mathrm{L_peak})$. Using this value, the luminance control can be carried out. In this case, it is difficult to reconstruct a complete original image. However, it is possible to reconstruct the original image with few discernible defects.

As described above, the display luminance of each of the regions A1 to A6 is effected by not only the emission luminance of one of the light sources 8 to 13 immediately behind the regions A1 to A6 but also the emission luminance of the other light sources 8 to 13. Accordingly, simply by controlling the emission luminance of each of the light sources 8 to 13 immediately behind the regions A1 to A6 in accordance with the recovery limits $\alpha n$ of the regions A1 to A6, the control cannot be carried out in consideration of the emission luminance of the light sources 8 to 13 that are not located immediately behind the regions A1 to A6.

Therefore, the emission ratio $\beta n$ (n=1, . . . 6) is computed in consideration of the emission luminance of the light sources 8 to 13 that are not located immediately behind the regions A1 to A6. The emission ratio $\beta n$ refers to a ratio of the actual emission luminance of one of the light sources 8 to 13 to the maximum emission luminance thereof (i.e., the emission luminance when the white peak is set). The emission ratio $\beta n$ is in the range of $0 \leqq \beta n \leqq 1$.

The emission ratio $\beta n$ is computed using the contribution ratio $K_{X,Y}$ of each of the light sources 8 to 13 to the luminance of one of the regions A1 to A6 (see FIG. 5). As described above, the data of the contribution ratio of each of the light sources 8 to 13 to the luminance is prestored in the memory 16 and is read out of the memory 16 when the emission ratio $\beta n$ is computed.

In the contribution ratio $K_{X,Y}$ X represents one of the regions A1 to A6 and Y represents one of the light sources 8 to 13. For example, $K_{1,1}$ represents the contribution ratio of the light source 8 located at the top to the luminance of the region A1. $K_{2,3}$ represents the contribution ratio of the light source 10 located at the third from the top to the luminance of the region A2. As shown in FIG. 5, the contribution ratio of each of the light sources 8 to 13 is not constant in each area. However, in the memory 16, the contribution ratio $K_{X,Y}$ is stored as the value at the middle of each of the regions A1 to A6.

The emission ratio $\beta n$ can be computed by solving the following multiple simultaneous equations (inequality expressions):

$$K_{1,1}\cdot\beta_1+K_{1,2}\cdot\beta_2+K_{1,3}\cdot\beta_3+K_{1,4}\cdot\beta_4+K_{1,5}\cdot\beta_5K_{1,6}\cdot\beta_6 \geqq \alpha_1 \quad (2)$$

$$K_{2,1}\cdot\beta_1+K_{2,2}\cdot\beta_2+K_{2,3}\cdot\beta_3+K_{2,4}\cdot\beta_4+K_{2,5}\cdot\beta_5K_{2,6}\cdot\beta_6 \geqq \alpha_2 \quad (3)$$

$$K_{3,1}\cdot\beta_1+K_{3,2}\cdot\beta_2+K_{3,3}\cdot\beta_3+K_{3,4}\cdot\beta_4+K_{3,5}\cdot\beta_5K_{3,6}\cdot\beta_6 \geqq \alpha_3 \quad (4)$$

$$K_{4,1}\cdot\beta_1+K_{4,2}\cdot\beta_2+K_{4,3}\cdot\beta_3+K_{4,4}\cdot\beta_4+K_{4,5}\cdot\beta_5K_{4,6}\cdot\beta_6 \geqq \alpha_4 \quad (5)$$

$$K_{5,1}\cdot\beta_1+K_{5,2}\cdot\beta_2+K_{5,3}\cdot\beta_3+K_{5,4}\cdot\beta_4+K_{5,5}\cdot\beta_5K_{5,6}\cdot\beta_6 \geqq \alpha_5 \quad (6)$$

$$K_{6,1}\cdot\beta_1+K_{6,2}\cdot\beta_2+K_{6,3}\cdot\beta_3+K_{6,4}\cdot\beta_4+K_{6,5}\cdot\beta_5K_{6,6}\cdot\beta_6 \geqq \alpha_6 \quad (7)$$

After computing the emission ratio $\beta n$ ($0 \leqq \beta n \leqq 1$) by solving the multiple simultaneous equations, the emission luminance of each of the light sources 8 to 13 is set so as to satisfy the computed emission ratio $\beta n$.

It should be noted that since, in the above-described multiple simultaneous equations, only n changes in accordance with the number of divided backlights, the simultaneous equations can be used regardless of the structure of a backlight.

Additionally, in the foregoing description, $\beta n$ is computed for each of the light sources 8 to 13. However, $\beta n$ may be computed, for example, for each of primitive colors (i.e., red, green, and blue) or for each emission color of the backlight 3 to control the luminance.

Figure 7:
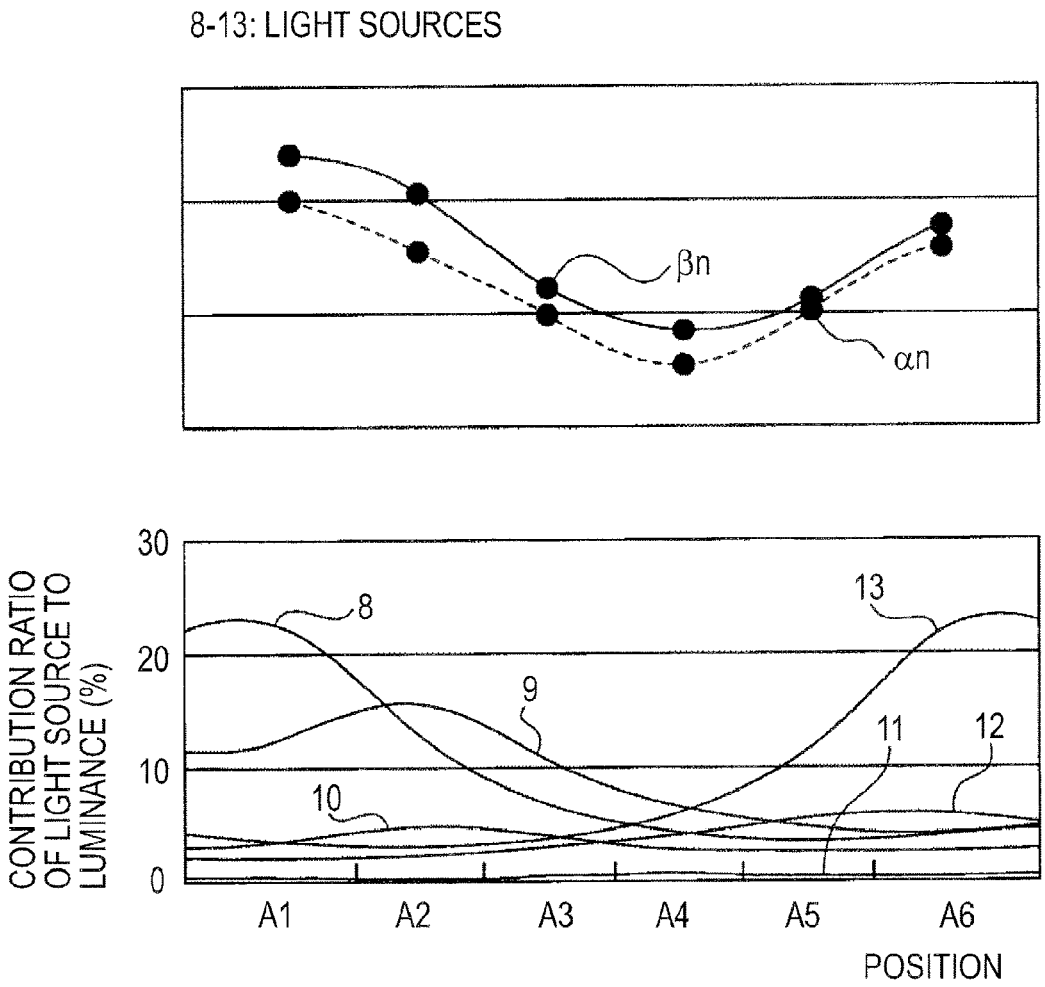
FIG. 7 is graphs illustrating the contribution ratios of light sources to the luminance, the recovery limits, and the emission ratios when a given image is displayed.

FIG. 7 is graphs illustrating the luminance state when the emission ratio $\beta n$ is computed in response to an input signal and the emission luminance of the light sources 8 to 13 of the backlight 3 is controlled using the above-described method.

In FIG. 7, the abscissa represents the location in the display screen in the vertical direction. In the upper graph, data at each point which are connected by a dotted curve represents the recovery limit $\alpha n$, while data at each point which are connected by a solid curve represent the sum of the emission ratio $\beta n$ of the light sources 8 to 13 in the regions A1 to A6. The lower graph represents the contribution ratios of the light sources 8 to 13 to the luminance.

In the example shown in FIG. 7, the display luminance of the region A4 is the lowest. The display luminance increases with distance from the region A4. The display luminance of the region A1 is the highest. The emission luminance of the light source 11 is near zero. The emission luminance of the light sources 10 and 12 is low. The emission luminance of the light sources 8, 9, and 13 is set to be higher than that of the light sources 10, 11, and 12.

As shown in FIG. 7, the emission ratio $\beta n$ is set to a value close to the recovery limit $\alpha n$, and therefore, the emission luminance of the light sources 8 to 13 is efficiently controlled.

As stated above, by solving the multiple simultaneous equations using the recovery limit $\alpha n$ and the contribution ratio $K_{X,Y}$ the emission ratios $\beta n$ of the light sources 8 to 13 are obtained so as to control the emission luminance of the light sources 8 to 13. This method allows the emission luminance of the light sources 8 to 13 to be reduced in accordance with the display state of an image, and therefore, the power consumption of the backlight 3 can be reduced.

After the emission ratios $\beta n$ is computed and the emission luminance of the light sources 8 to 13 is set in the above-described manner, the correction value for each pixel is computed to set the display luminance at each location in the display screen of the liquid crystal panel 5 to the optimal value when displaying an image. As described above, this correction value is a value for computing the aperture ratio of each pixel to obtain the display luminance required for each location of the display screen when light is emitted from the light sources 8 to 13 at the emission luminance level set in the above-described manner.

Figure 8:
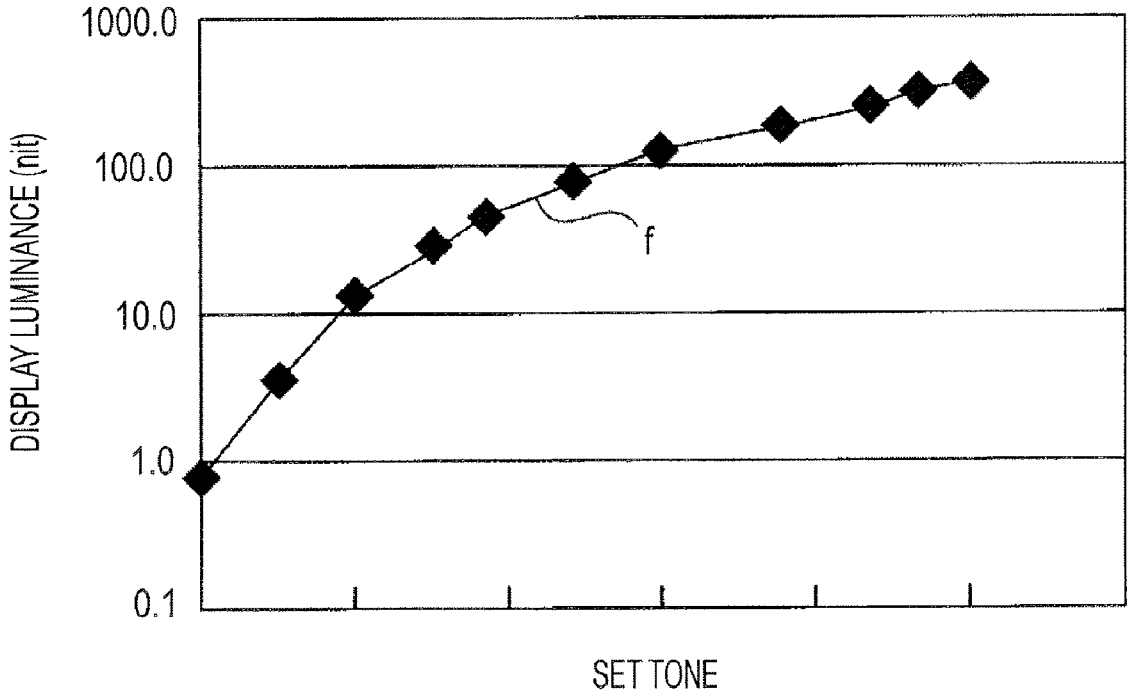
FIG. 8 is a graph illustrating the display luminance characteristic.

The correction value is computed on the basis of data about the display luminance characteristic of the liquid crystal panel 5 shown in FIG. 8. In FIG. 8, the abscissa represents a set tone (voltage) S_data of the liquid crystal panel 5 when the output of the backlight 3 is 100% (all lit) and the ordinate represents the display luminance L_data of the liquid crystal panel 5 for the set tone S_data. The data about the display luminance characteristic f shown in FIG. 8 is obtained in advance and are stored in the memory 16.

For each pixel, let $\gamma$ be the ratio of the all-white display luminance L_peak to a set display luminance L_set. The set display luminance L_set refers to display luminance when the aperture ratio of the pixel is set to 100% and light is emitted from the light sources 8 to 13 whose emission luminance is set on the basis of the emission ratios $\beta n$.

That is, $$\gamma = L_peak / L_set \quad (8)$$

As described above, the set tone S_data of an image (original image) displayed when an image signal is input is determined by the display luminance L_data according to the data shown in FIG. 8.

That is, $$L_data = f(S_data) \quad (9)$$

Additionally, a corrected set tone S_data' for the set display luminance L_set is computed using the following equation on the basis of the ratio γ of the all-white display luminance L_peak to a set display luminance L_set and the set tone S_data. The corrected set tone S_data' is the correction value used to compute the aperture ratio required for each pixel.

That is, $$S_data' = f(\gamma \times L_data)^{-t} \quad (10)$$

By setting the aperture ratio of each pixel to achieve the corrected set tone S_data', the original image can be played back at a predetermined display luminance level.

In the liquid crystal display device 1, when computing the correction value for each pixel, the following process is carried out to correct the luminance non-uniformity of the liquid crystal panel 5.

When the liquid crystal panel 5 is set to the all-white display luminance L_peak, the luminance non-uniformity appears on the liquid crystal panel 5. This luminance non-uniformity is caused by the molding precision of components associated with the display luminance of the liquid crystal panel 5 (e.g., a pixel (liquid crystal) and a light source).

A method for preventing the luminance non-uniformity is now herein described with reference to FIGS. 9 and 10.

Figure 9:
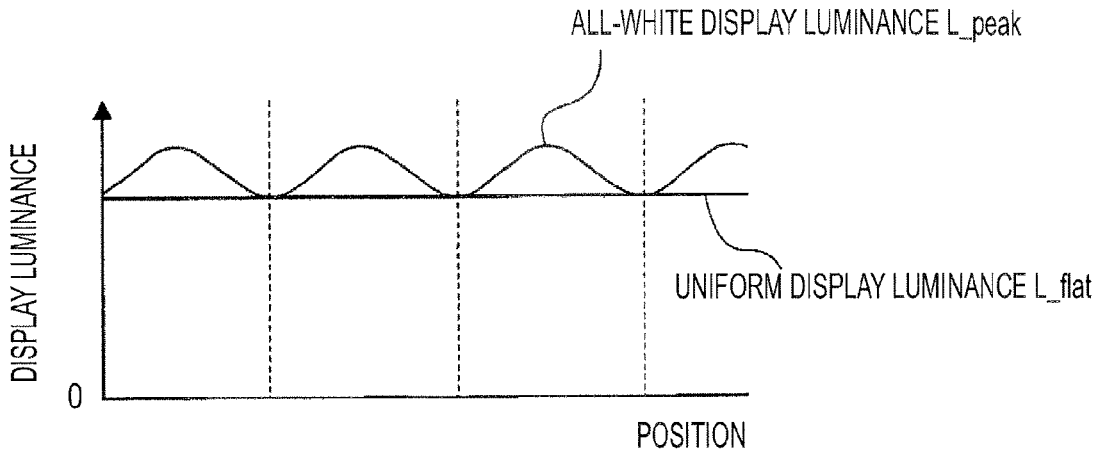
FIGS. 9 and 10 illustrate the process of correcting luminance non-uniformity, where

As shown in FIG. 9, for the display luminance at each position in the display screen, let the minimum value of the all-white display luminance L_peak denote a uniform display luminance L_flat. At that time, if a particular location that exhibits low display luminance is found, the low display luminance may be ignored when determining the uniform display luminance L_flat.

Subsequently, for each pixel, a ratio H is computed that is a ratio of the uniform display luminance L_flat to the all-white display luminance L_peak (i.e., H=L_flat/L_peak). The ratio H is stored in the memory 16 as a non-uniformity correction coefficient.

Figure 10:
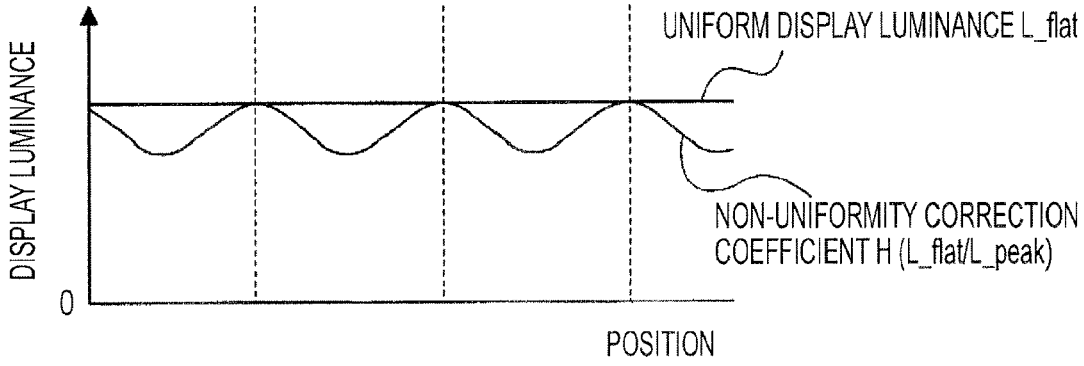

FIG. 10 illustrates the non-uniformity correction coefficient H computed for the display luminance state shown in FIG. 9.

Thus, the non-uniformity correction coefficient H is computed. By computing the corrected set tone S_data' using the following equation including the non-uniformity correction coefficient H, the luminance non-uniformity of the liquid crystal panel 5 can be corrected:

$$S_data' = f(H \times \gamma \times L_data)^{-1} \quad (11)$$

As stated above, in the liquid crystal display device 1, by controlling the emission luminance of the light sources 8 to 13 and the aperture ratio of each pixel of the liquid crystal panel 5 in accordance with an input image signal, the quality of an image can be improved while reducing the power consumption.

Moreover, the emission luminance of the light sources 8 to 13 is independently controlled, and the light emitted from the light sources 8 to 13 is not partitioned. Accordingly, the structure can be similar to a simple structure of known liquid crystal display devices that do not carry out light amount control.

Furthermore, in the liquid crystal display device 1, the luminance non-uniformity of the liquid crystal panel 5 is corrected while controlling the emission luminance of the light sources 8 to 13 and the aperture ratio of each pixel of the liquid crystal panel 5. Accordingly, the image quality is further improved.

Still furthermore, in the liquid crystal display device 1, a single memory 16 stores different types of data including data used to correct the luminance non-uniformity of the liquid crystal panel 5, data about the distribution of light emitted from the light sources 8 to 13, and data about the contribution ratio that indicates how much the emission luminance of the light sources 8 to 13 contributes to the display luminance of the regions A1 to A6. Therefore, a plurality of memories for independently storing these data are not necessary. As a result, the control operation can be carried out without increasing the manufacturing cost.

Figures 11A, 11B:
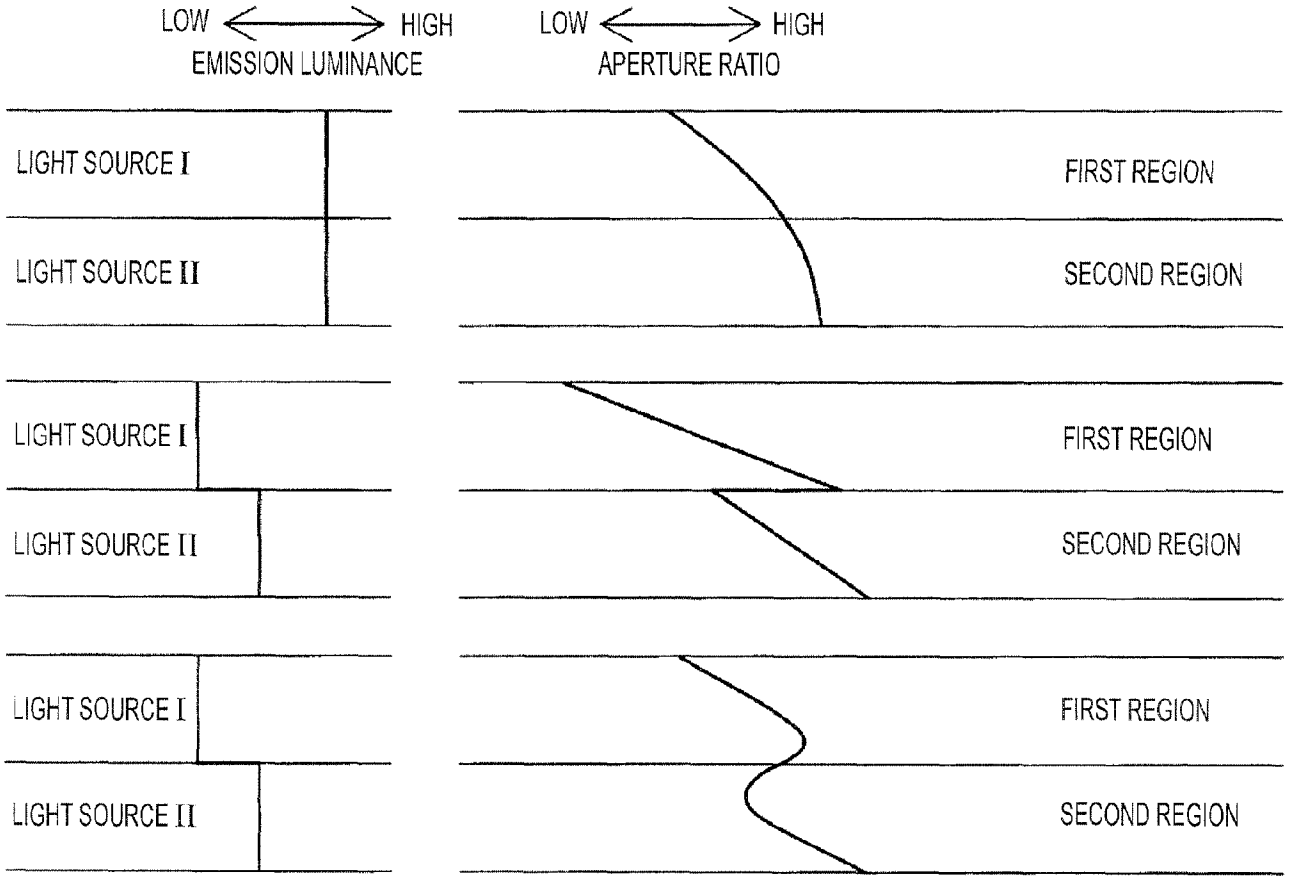
FIG. 11A RELATED ART
FIG. 11B RELATED ART

An example of a control according to the above-described method is now herein described with reference to FIGS. 11A-C while comparing with a known control method. For the sake of simplicity, in FIGS. 11A-C, the display screen is divided into only two regions (first and second regions). The display luminance of the first region is lower than that of the second region. Additionally, the display luminance gradually increases from the top to the bottom of the display screen composed of the first and second regions. In FIGS. 11A-C, the left side represents the emission luminance of a light source while the right side represents the aperture ratio of a pixel. In FIGS. 11A-C, the same image is displayed at the same display luminance level.

FIG. 11A illustrates an example of a known control method in which the emission luminance of a light source is set to be maximum and a predetermined display luminance is obtained by controlling the aperture ratio of a pixel.

In the example shown in FIG. 11A, since the emission luminance of a light source is set to be maximum at all times regardless of the required display luminance, the power consumption becomes high.

FIG. 11B illustrates an example of a known control method in which the emission luminance of a light source is set to be lower than the maximum luminance, the emission luminance of a light source I disposed immediately behind the first region is set to be lower than the emission luminance of a light source II disposed immediately behind the second region, and a predetermined display luminance is obtained by controlling the aperture ratio of a pixel. A partition is provided between the first region and the second region.

In the example shown in FIG. 11B, since the first region and the second region are partitioned and the light source I and the light source II are independently controlled, the aperture ratios of pixels in the border area between the first region and the second region significantly change. The significant change in the aperture ratios of pixels appears in the form of the luminance non-uniformity of a display caused by dependence of the luminance on the viewing angle when the display screen is viewed from an oblique direction.

FIG. 11C illustrates an example of the liquid crystal display device 1 according to an embodiment of the present invention, in which the emission luminance of a light source is set to be lower than the maximum luminance, the emission luminance of a light source I disposed immediately behind the first region is set to be lower than the emission luminance of a light source II disposed immediately behind the second region, and a predetermined display luminance is obtained by controlling the aperture ratio of a pixel. The emission luminance is equal to that in FIG. 11B. A partition is not provided between the first region and the second region.

In the example shown in FIG. 11C, since the first region and the second region is not partitioned and the light source I and the light source II are controlled in consideration of the effect of the light source I and the light source II on the entire display screen, the aperture ratios of pixels in the border area between the first region and the second region gradually change. Unlike the example shown in FIG. 11B, the gradual change in the aperture ratios of pixels does not generate the luminance non-uniformity of a display caused by dependence of the luminance on the viewing angle. Thus, the quality of an image can be increased.

Figure 12:
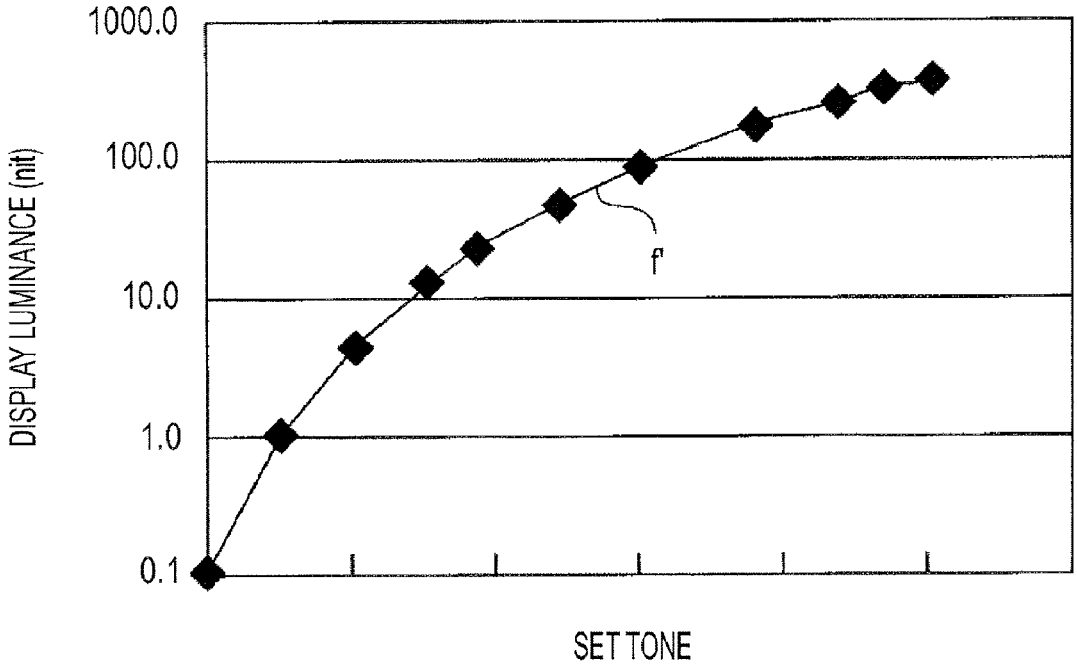
FIG. 12 is a graph illustrating the display luminance characteristic for increasing a dynamic range.
Figure 13:
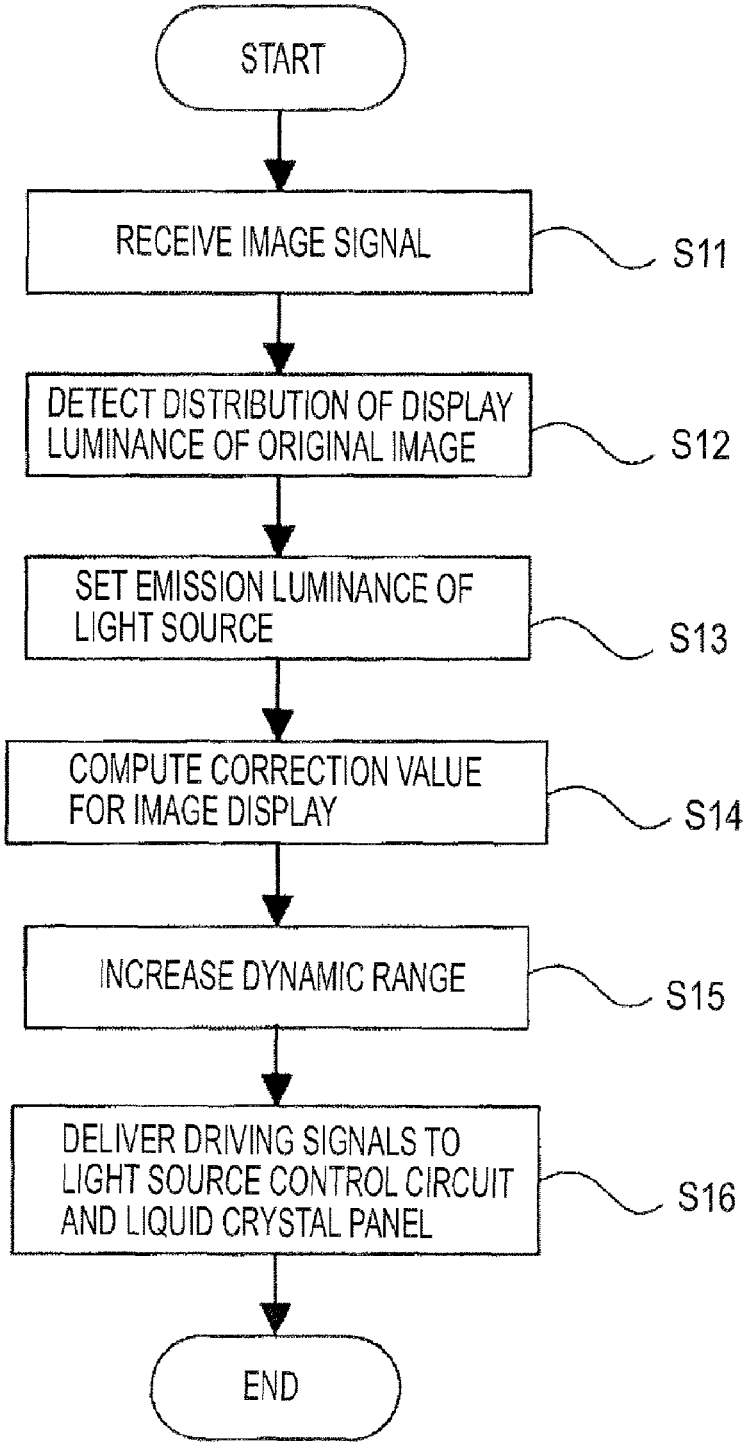
FIG. 13 is a flow chart of the control process to increase the dynamic range.

An example of a control in order to increase the dynamic range of a control amount of the display luminance of each of the light sources 8 to 13 and the dynamic range of a correction value for each pixel is now herein described with reference to FIGS. 12 and 13.

In the foregoing description, the data shown in FIG. 8 is stored in the memory 16 as the data about the display luminance characteristic of the display screen. By using another type of data as the data about the display luminance characteristic of the display screen stored in the memory 16, the dynamic range can be increased.

The data shown in FIG. 8 is data having the display luminance characteristic f that represents a black color (black level) when the backlight 3 emits light. However, as shown in FIG. 12, data can be used that has a display luminance characteristic f' that represents a black color (black level) when the backlight 3 emits no light. By using such data, the dynamic range can be increased for the control amount of the display luminance of each of the light sources 8 to 13 and for the correction value for each pixel.

An example of a control process of a screen display in order to increase the dynamic range of a control amount of the display luminance of each of the light sources 8 to 13 and the dynamic range of a correction value for each pixel is now herein described with reference to a flow chart of FIG. 13. This control process is executed by the liquid crystal panel control circuit 14 and the light source control circuit 15 of the control unit 4 every time a one-field image signal is input to the liquid crystal panel control circuit 14.

First, processes at steps S11 through S13 are sequentially carried out. The processes at steps S11 through S13 are similar to the processes at steps S1 through S3 shown in FIG. 6.

Subsequently, a correction value for each pixel is computed to set the display luminance of each location in the display screen of the liquid crystal panel 5 to be an optimal value when displaying an image (step S14). To compute the correction value, the data having the display luminance characteristic f' shown in FIG. 12 is read out of the memory 16. By computing the correction value using the data having the display luminance characteristic f' shown in FIG. 12, the dynamic range can be increased for the control amount of the display luminance of each of the light sources 8 to 13 and for the correction value for each pixel (step S15).

Subsequently, the liquid crystal panel control circuit 14 delivers display driving signals corrected on the basis of the correction values computed at steps S14 and S15 to the pixels of the liquid crystal panel 5. Thus, an image of each field is displayed on the display screen (step S16). When the display driving signals are delivered from the liquid crystal panel control circuit 14 to the pixels of the liquid crystal panel 5, the pixels are controlled so that the aperture ratios of the pixels equal to the aperture ratios defined by the display driving signals. Thus, the transmission of light emitted from the light sources 8 to 13 through the pixels is controlled. The process at step S16 is similar to the process at step S5 shown in FIG. 6.

As described above, by increasing the dynamic range for the control amount of the display luminance of each of the light sources 8 to 13 and the correction value for each pixel, the quality of the image can be increased. This dynamic range increasing process can be carried out, for example, for each of primitive colors (i.e., red, green, and blue) or for each emission color of the backlight 3 to control the luminance.

In the foregoing description, in the liquid crystal display device 1, the display screen is divided into the six regions A1 to A6, and the six light sources 8 to 13 which respectively correspond to the six regions A1 to A6 are disposed to control the emission luminance. However, as in the following liquid crystal display device 1A, a plurality of light sources may be disposed for each of regions A1 to A6, and the emission luminance of the plurality of light sources disposed for each region may be controlled as one unit.

In the following description, the liquid crystal display device 1A is only different from the liquid crystal display device 1 in that a different number of light sources is disposed for one region and the emission luminance of a plurality of light sources is controlled as one unit. Accordingly, only the parts different from those of the liquid crystal display device 1 are described in detail. For the other parts, the same reference numerals are used to designate corresponding parts of the liquid crystal display device 1 and the descriptions are not repeated.

Figure 14:
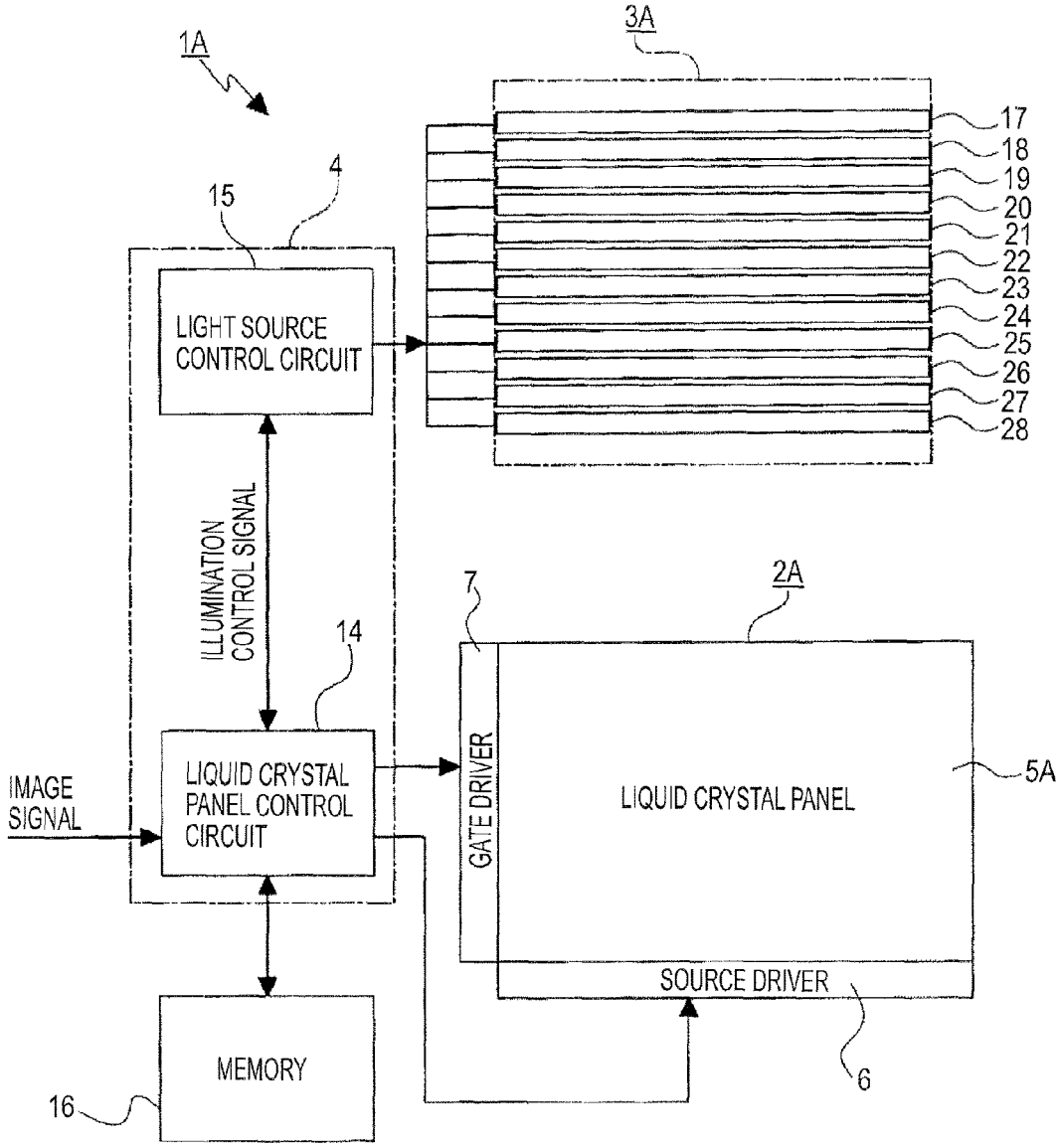
FIG. 14 is a block diagram of the structure of a different liquid crystal display device.
Figure 15:
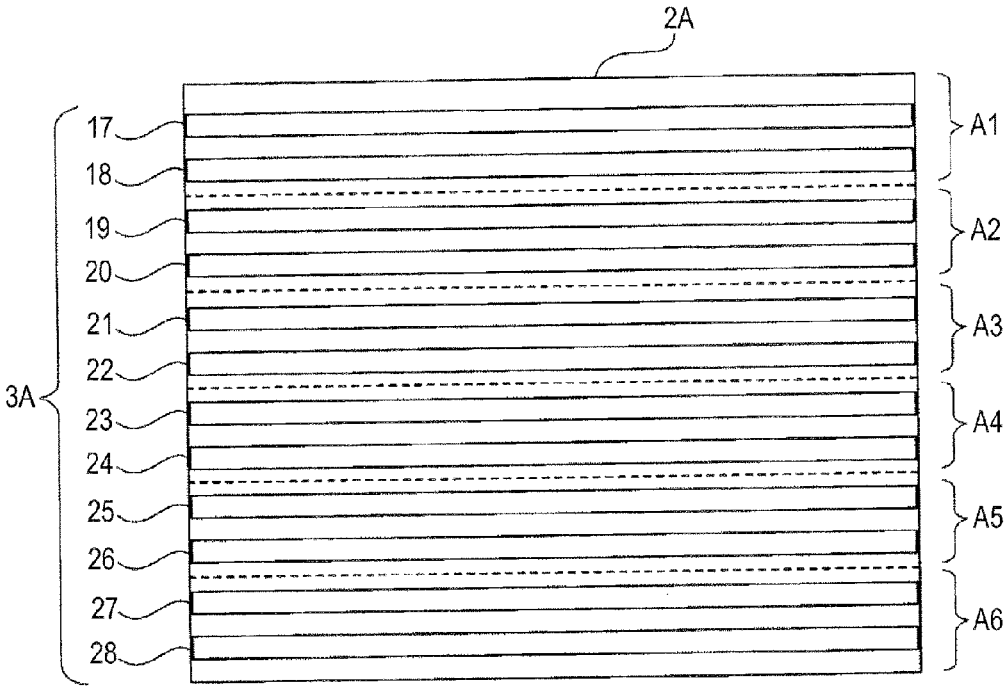
FIG. 15 is a front view schematically illustrating a display unit and a backlight of the different liquid crystal display device.

As shown in FIG. 14, the liquid crystal display device 1A includes a display unit 2A, a backlight 3A, and a control unit 4.

The display unit 2A includes a liquid crystal panel 5A, a source driver 6, and a gate driver 7. The source driver 6 and the gate driver 7 deliver a driving signal to the liquid crystal panel 5A. The display screen of the liquid crystal panel 5A is divided into a plurality of regions; for example, six vertically divided regions A1 to A6 (see FIG. 15).

The backlight 3A includes a plurality of light sources, for example, twelve light sources 17 to 28. A pair of the two adjacent light sources of the twelve light sources 17 to 28 is disposed immediately behind each of the six regions A1 to A6 of the display screen. Each of the light sources 17 to 28 includes a plurality of horizontally arranged light emitting elements (e.g., light emitting diodes).

Like the backlight 3, the structure of the backlight 3A is not limited to the structure that includes only the vertically divided and arranged light sources 17 to 28. Alternatively, the backlight 3A may include only the horizontally divided and arranged light sources. In addition, the backlight 3A may include vertically and horizontally divided and arranged light sources.

The light source control circuit 15 controls each of the light sources 17 to 28 (see FIG. 14). When the liquid crystal panel control circuit 14 receives an image signal, the liquid crystal panel control circuit 14 inputs an illumination control signal for each of the light sources 17 to 28 into the light source control circuit 15 so that the emission luminance of the light sources 17 to 28 are independently set at one field cycle.

In the liquid crystal display device 1A, the emission luminance is controlled for the two light sources disposed for each of the regions A1 to A6 as one unit. That is, the light source control circuit 15 controls the two light sources disposed for each of the regions A1 to A6 so that each of the two light sources is set to the same emission luminance level at the same time.

Figure 16:
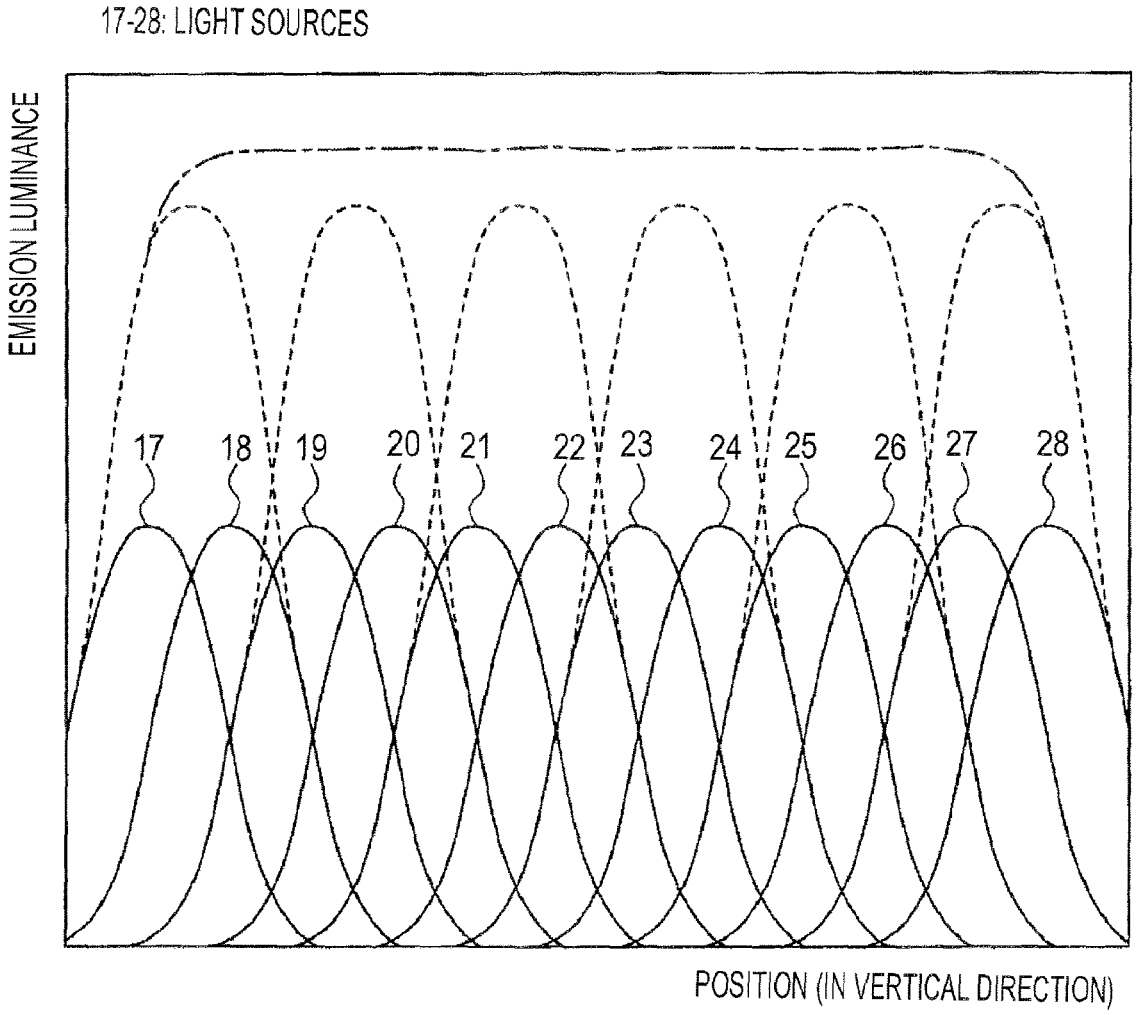
FIG. 16 is a graph illustrating the emission luminance of light sources at different positions in a display screen of the different liquid crystal display device.

FIG. 16 illustrates an example of emission luminance of the light sources 17 to 28. In FIG. 16, the abscissa represents the vertical position in the display screen and the ordinate represents the emission luminance. Each of the light sources 17 to 28 is illuminated substantially at its maximum uniform luminance level.

In FIG. 16, the data represented by solid lines indicate emission luminance of the light sources 17 to 28. Here, the effect of light reflected off either end of the display screen in the vertical direction (i.e., the ends of the light sources 17 and 28) is not taken into account in these data. The data represented by dotted lines indicate emission luminance of the pairs of two light sources in the regions A1 to A6. The data represented by a dashed line indicates the total emission luminance of the light sources 17 to 28 at a location in the vertical direction. The total emission luminance at any point in the vertical direction is set to substantially the same with the exception of the total emission luminance at either end of the display screen in the vertical direction.

As described above, when the light sources 17 to 28 are illuminated substantially at the uniform intensity level, the total emission luminance decreases at either end of the display screen in the vertical direction. However, at either end of the display screen in the vertical direction, the emission luminance of the light sources 17 and 18 increases due to the effect of reflecting light. Accordingly, like the liquid crystal display device 1, in the liquid crystal display device 1A, the decrease in the total emission luminance is mitigated at either end of the display screen in the vertical direction.

In addition, like the liquid crystal display device 1, in the liquid crystal display device 1A, in order to avoid the decrease in the total emission luminance at either end of the display screen in the vertical direction as much as possible, the maximum emission luminance of the light sources 17 and 28, which are located at either end of the display screen in the vertical direction, may be increased compared with that of the other light sources 18 to 27.

Furthermore, like the liquid crystal display device 1, in order to completely avoid the decrease in the total emission luminance at either end of the display screen in the vertical direction, the area that does not include the either end of the display screen in the vertical direction may be defined as an image displayable area.

Like the liquid crystal display device 1, the liquid crystal display device 1A does not include a partition that prevents light emitted from each of the light sources 17 to 28 from reaching regions other than the region immediately in front of the light source.

Accordingly, in the liquid crystal display device 1A, light emitted from each of the light sources 17 to 28 reaches the region other than the region immediately at the front of the light source. Therefore, the light emitted from each of the light sources 17 to 28 illuminates not only one of the regions A1 to A6 immediately in front of the light source, but also the other regions.

In the liquid crystal display device 1A, the contribution levels of the emission luminance of each of the light sources 17 to 28 to the regions A1 to A6 are also measured in advance and are stored in the memory 16. These measurement values serve as data of the contribution ratio to the luminance.

Figure 17:
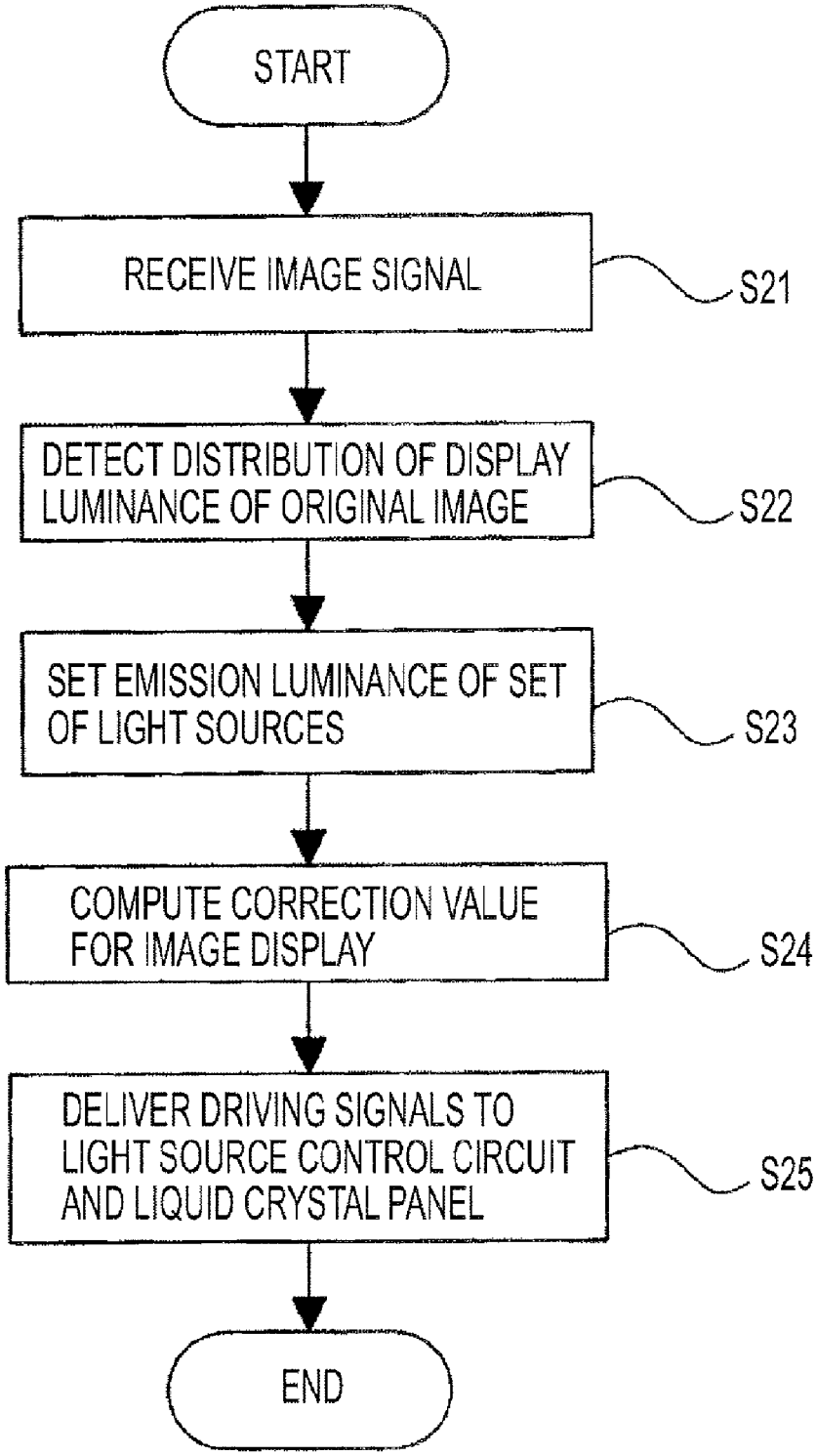
FIG. 17 is a flow chart of the control procedure of the different liquid crystal display device.

The control process of the screen display is now herein described with reference to a flow chart shown in FIG. 17. This process is executed by the liquid crystal panel control circuit 14 and the light source control circuit 15 of the control unit 4 every time a one-field image signal is input to the liquid crystal panel control circuit 14.

Upon receiving a one-field image signal (step S21), the liquid crystal panel control circuit 14 identifies the distribution of display luminance of one image (original image) generated from the input image signal (step S22). The processes at steps S21 and S22 are similar to the processes at steps S1 and S2 of the liquid crystal display device 1 (see FIG. 6).

On the basis of the identified distribution of display luminance, the display luminance is set for each of the light sources 17 to 28 of the backlight 3A (step S23). Here, the setting of the display luminance is carried out for each pair of adjacent light sources. Accordingly, the same value is set for the display luminance of the light sources 17 and 18 disposed so as to correspond to the region A1, the display luminance of the light sources 19 and 20 disposed so as to correspond to the region A2, the display luminance of the light sources 21 and 22 disposed so as to correspond to the region A3, the display luminance of the light sources 23 and 24 disposed so as to correspond to the region A4, the display luminance of the light sources 25 and 26 disposed so as to correspond to the region A5, and the display luminance of the light sources 27 and 28 disposed so as to correspond to the region A6. This display luminance is set with consideration of the contribution ratios of the emission luminance of each of the light sources 17 to 18 to the display luminance of the regions A1 to A6.

After the emission luminance of each of the light sources 17 to 28 is set as described above, a correction value for each pixel is computed to obtain an optimal display luminance value when the image is displayed on the display screen of the liquid crystal panel 5A (step S24). The process at step S24 is similar to the process at step S4 of the liquid crystal display device 1 (see FIG. 6). To compute this correction value, either data of the display luminance characteristic f shown in FIG. 8 or data of the display luminance characteristic f' shown in FIG. 12 may be used.

Subsequently, the light source control circuit 15 delivers light emission driving signals in accordance with the emission luminance of the light sources 17 to 28 set at step S23 to the light sources 17 to 28, respectively. Thus, the light sources 17 to 28 emit light at the set emission luminance levels. At the same time, the liquid crystal panel control circuit 14 delivers display driving signals corrected on the basis of the correction values computed at step S24 to pixels of the liquid crystal panel 5A. Thus, an image of each field is displayed on the display screen (step S25). The process at step S25 is similar to the process at step S5 of the liquid crystal display device 1 (see FIG. 6).

As described above, like the liquid crystal display device 1, in the liquid crystal display device 1A, the emission luminance of each of the light sources 17 to 28 and the aperture ratio of each pixel of the liquid crystal panel 5A are controlled in accordance with the input image signal in each region of the display screen. Consequently, the quality of an image displayed on the liquid crystal panel 5A can be increased while reducing the power consumption.

Moreover, although the emission luminance of the light sources 17 to 28 of the backlight 3A is independently controlled, the light emitted from the light sources 17 to 28 is not partitioned. Accordingly, the structure can be similar to a simple structure of known liquid crystal display devices that do not carry out light amount control.

Furthermore, in the liquid crystal display device 1A, the luminance increases as the number of the light sources increases. In addition, since the emission luminance is controlled for a set of a plurality of light sources, the control process of the emission luminance can remain simple even when the number of light sources increases. Accordingly, the control process of the emission luminance can be facilitated while increasing the emission luminance.

Although the liquid crystal display device 1A that controls the emission luminance of a set of two light sources has been described in particular, other numbers of light sources in the set are also applicable. For example, three or more light sources can be disposed for each region and the emission luminance control may be carried out for a set of these light sources.

In addition, although the liquid crystal display device 1 and the liquid crystal display device 1A that respectively include six and twelve light sources have in particular been described, other numbers of light sources are also applicable. Any plural number of light sources may be applicable.

Furthermore, the number of divided regions is not limited to six. Any number of divided regions is applicable.

The directions described in the foregoing embodiments (i.e., vertical and horizontal directions) are only for description purpose. The present invention is not limited to these directions.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a display unit having a display screen divided into a plurality of regions, each region having a plurality of pixels, each pixel having a transmittance ratio, the display unit being controlled using the transmittance ratio of each pixel on a pixel-by-pixel basis;

a backlight for illuminating the back surface of the display unit, the backlight including a plurality of sets of light sources, each set being disposed so as to correspond to one of the regions; and a control unit which (a) identifies the display luminance in each region of the display unit when an image is displayed on the display unit on the basis of an input image signal, (b) computes the emission luminance of each light source disposed so as to correspond to one of the divided regions based on the identified display luminance and predetermined data stored in a memory regarding an effect on the region of the other light sources not corresponding to the region, (c) independently sets the emission luminance of each light source to the computed emission luminance for each light source, (d) computes a correction value for each pixel of the display unit on the basis of a shift amount between the set emission luminance and an optimal display luminance value for one of the divided regions of the display screen, and (e) delivers a display driving signal generated on the basis of the computed correction value to each pixel so as to control the luminance of the pixel.

2. The display apparatus according to claim 1, wherein emission luminance is computed for each set of the plurality of light sources such that the emission luminance is set to the same value.

3. The display apparatus according to claim 1, wherein the computation of the emission luminance of each light source while taking into account an effect on the region of the other light sources not corresponding to the region is performed by solving simultaneous equations using the predetermined data, the predetermined data being contribution ratios of the emission luminance of all the light sources to the luminance in the region.

4. The display apparatus according to claim 1, wherein the control unit defines a dynamic range of the display luminance in each divided region of the display unit when the image signal is input as the display state of the display unit in the range from an emission luminance of zero to an emission luminance of substantially the maximum value of the light source corresponding to the divided region so as to identify the display luminance of each divided region of the display unit.

5. A display method for use in a display apparatus, the display apparatus including a display unit having a display screen divided into a plurality of regions, each region having a plurality of pixels, each pixel having a transmittance ratio, the display unit being controlled using the transmittance ratio of each pixel on a pixel-by-pixel basis, and a backlight for illuminating the back surface of the display unit, the backlight including a plurality of sets of light sources, each set being disposed so as to correspond to one of the regions, the method comprising the steps of:

identifying the display luminance in each region of the display unit when an image is displayed on the display unit on the basis of an input image signal;

computing the emission luminance of each light source disposed so as to correspond to one of the divided regions based on the identified display luminance and predetermined data stored in memory regarding an effect on the region of the other light sources not corresponding to the region;

independently setting the emission luminance of each light source to the computed emission luminance for each light source;

computing a correction value for each pixel of the display unit on the basis of a shift amount between the set emission luminance and an optimal display luminance value for one of the divided regions of the display screen; and delivering a display driving signal generated on the basis of the computed correction value to each pixel so as to control the luminance of the pixel.

6. The display method according to claim 5, wherein computing a correction value for each pixel of the display unit includes correcting a luminance non-uniformity of the display unit.

7. The display apparatus according to claim 1, wherein the optimal display luminance value is the display luminance required for each region of the display screen when the image is displayed on the basis of the input image signal.

8. The display method according to claim 5, wherein the optimal display luminance value is the display luminance required for each region of the display screen when the image is displayed on the basis of the input image signal.

* * * * *